US011445774B2

(12) United States Patent
Johnson et al.

(10) Patent No.: US 11,445,774 B2
(45) Date of Patent: Sep. 20, 2022

(54) COMPRESSIVE GARMENT HAVING AN OUTER LAYER

(71) Applicant: PUMA SE, Herzogenaurach (DE)

(72) Inventors: Charles Johnson, Nuremberg (DE); Hugh Clarke, Aurachtal (DE)

(73) Assignee: PUMA SE, Herzogenaurach (DE)

( * ) Notice: Subject to any disclaimer, the term of this patent is extended or adjusted under 35 U.S.C. 154(b) by 66 days.

(21) Appl. No.: 16/533,469

(22) Filed: Aug. 6, 2019

(65) Prior Publication Data

US 2021/0037902 A1 Feb. 11, 2021

(51) Int. Cl.

| | |
|---|---|
| ***A41D 31/00*** | (2019.01) |
| ***A41D 13/00*** | (2006.01) |
| ***A41D 1/08*** | (2018.01) |

(52) U.S. Cl.

CPC ..... *A41D 31/0005* (2013.01); *A41D 13/0015* (2013.01); *A41D 1/08* (2013.01); *A41D 2400/38* (2013.01); *A41D 2600/10* (2013.01)

(58) Field of Classification Search

CPC .. A41D 13/0015; A41D 1/08; A41D 2400/38; A41D 2600/10; A41D 1/089; A41D 17/02; A43D 13/0525; A43D 13/0531; A41B 9/14

USPC ..... 2/69

See application file for complete search history.

(56) References Cited

U.S. PATENT DOCUMENTS

| | | | | |
|---|---|---|---|---|
| 5,131,100 A | | 7/1992 | Atwater et al. | |
| 5,210,877 A | | 5/1993 | Newman | |
| 5,343,564 A | | 9/1994 | Reynolds et al. | |
| D378,317 S | * | 3/1997 | Wike | D2/712 |
| D400,338 S | | 11/1998 | Maves | |
| 6,047,406 A | * | 4/2000 | Dicker | A41D 13/0015 2/69 |
| D518,624 S | | 4/2006 | Zimmerman | |
| D520,715 S | | 5/2006 | Ota et al. | |

(Continued)

FOREIGN PATENT DOCUMENTS

| | | |
|---|---|---|
| JP | 2004263362 A | 9/2004 |
| JP | 2011021291 A | 2/2011 |

(Continued)

OTHER PUBLICATIONS

Definition of "portion" accessed via thefreedictionary.com. American Heritage® Dictionary of the English Language, Fifth Edition. (2011). Retrieved Jul. 8, 2021. https://www.thefreedictionary.com/portion. (Year: 2011).*

(Continued)

*Primary Examiner* — Jameson D Collier
*Assistant Examiner* — Matthew R Marchewka
(74) *Attorney, Agent, or Firm* — Quarles & Brady LLP

(57) ABSTRACT

A garment includes a substantially seamless base layer made from a compressive material, an outer layer positioned outward of at least a portion of the compressive material, and seam tape coupling the outer layer to the base layer. The outer layer is configured to cover less than an entire circumference of a wearer of the garment, and the base layer extends around at least a portion of the circumference not covered by the outer layer. For example, the outer layer may not cover a wearer's lateral thigh region, minimizing the availability of non-taut material in that region that may be subject to easier grabbing or manipulation by an opponent.

16 Claims, 45 Drawing Sheets

(56) References Cited

U.S. PATENT DOCUMENTS

| | | | | |
|---|---|---|---|---|
| D629,998 | S | 1/2011 | Lambertz | |
| D641,134 | S | 7/2011 | Zarabi | |
| D654,660 | S | 2/2012 | Jones et al. | |
| D655,479 | S | 3/2012 | Umbach et al. | |
| D663,924 | S | 7/2012 | Mullen | |
| D679,891 | S | 4/2013 | Mick | |
| 8,548,622 | B2 | 10/2013 | Berns et al. | |
| D730,583 | S | 5/2015 | Read | |
| RE46,331 | E | 3/2017 | Savage | |
| D783,943 | S | 4/2017 | Adrovic | |
| D790,161 | S | 6/2017 | Lee | |
| 9,687,031 | B2 | 6/2017 | Turner | |
| D794,909 | S | 8/2017 | Lomax | |
| D804,781 | S | 12/2017 | Kositchiranant | |
| D827,983 | S | 9/2018 | Mong et al. | |
| D839,543 | S | 2/2019 | Miller | |
| D848,115 | S | 5/2019 | Brown | |
| D872,972 | S | 1/2020 | Caron et al. | |
| D885,709 | S | 6/2020 | Jin | |
| 2005/0229293 | A1* | 10/2005 | Miller | A41D 1/089 2/403 |
| 2006/0230488 | A1* | 10/2006 | Rudolph | A41D 1/086 2/69 |
| 2010/0130903 | A1* | 5/2010 | Rock | D04B 1/243 602/62 |
| 2011/0107502 | A1 | 5/2011 | Dalhausser et al. | |
| 2011/0138524 | A1 | 6/2011 | Mfstad | |
| 2012/0260400 | A1* | 10/2012 | Franz | A41D 1/06 2/228 |
| 2015/0257454 | A1 | 9/2015 | Johnson | |
| 2016/0007662 | A1* | 1/2016 | Powell | A41D 1/089 2/228 |
| 2016/0095367 | A1* | 4/2016 | Curran | A41D 1/084 2/243.1 |
| 2016/0295933 | A1* | 10/2016 | Herbener | A41D 27/20 |
| 2017/0295859 | A1* | 10/2017 | Butler | A41D 31/02 |
| 2017/0318868 | A1* | 11/2017 | Luong | A41D 1/08 |
| 2018/0206567 | A1* | 7/2018 | Diakonov | A41D 27/207 |
| 2018/0279699 | A1* | 10/2018 | Olmos Plaza | A41D 15/002 |
| 2018/0325188 | A1 | 11/2018 | Burhance et al. | |
| 2019/0015283 | A1* | 1/2019 | Jackson | A61H 1/00 |
| 2019/0045856 | A1 | 2/2019 | Musciacchio | |
| 2019/0150540 | A1* | 5/2019 | Otashevich | A41D 1/06 |
| 2019/0373969 | A1* | 12/2019 | Bolker | A41D 1/089 |
| 2020/0360754 | A1 | 11/2020 | Kehler et al. | |

FOREIGN PATENT DOCUMENTS

| | | | |
|---|---|---|---|
| JP | 2013189743 | A | 9/2013 |
| JP | 2015206146 | A | 11/2015 |
| WO | 2015/162945 | A1 | 10/2015 |
| WO | 2016173031 | A1 | 11/2016 |

OTHER PUBLICATIONS

First Office Action from corresponding Japanese Patent Application No. 2020-545247 dated Oct. 19, 2021 (8 pages) including English translation.

* cited by examiner

COMPRESSIVE GARMENT HAVING AN OUTER LAYER

CROSS REFERENCE TO RELATED APPLICATIONS

Not applicable

REFERENCE REGARDING FEDERALLY SPONSORED RESEARCH OR DEVELOPMENT

Not applicable

SEQUENCE LISTING

Not applicable

BACKGROUND OF THE INVENTION

1. Field of the Invention

The present disclosure relates generally to a garment intended to optimize comfort, mobility, and breathability while reducing the surface area that can be grabbed or pulled by opponents in sporting events.

2. Description of the Background of the Invention

In contact sports, athletes execute aggressive, physical actions when attempting to outperform opponents. These athletic actions often include grabbing or pulling the opponents' garments, which can be more easily accomplished depending on the style of the garments being worn. In particular, loose-fitting outer garments such as a top (e.g., a shirt or jersey) or bottom piece (e.g., shorts or pants) may leave the athlete wearing such garments vulnerable to being grabbed and pulled by an opponent, potentially putting the athlete at a competitive disadvantage.

In addition to the loose outer layers, many players wear compression-type undergarments or accessories for a multiplicity of reasons, actual or perceived, including: comfort, reduced muscle fatigue or soreness and/or faster muscle recovery, strain or other injury prevention, increased muscle oxygenation, and improved body temperature regulation. Because these undergarments are separate from the outer garments, such garments result in additional bulk and may be susceptible to rolling and sliding. Moreover, compression undergarments are commonly constructed from one fabric type having uniform stretch resistance, which can be restrictive during intense physical activity.

Furthermore, because of the intensity of contact sports, athletes can experience excessive sweating, which, combined with rapid movement, may lead to rubbing of clothing material against the athlete's skin. Such rubbing may be exacerbated by compression articles since they are intended, by design, to remain in contact with or close proximity to the wearer's skin. The rubbing may lead to discomfort and/or chafing, especially in the skin areas that are in contact with seams and waistbands or that are more sensitive than other parts of the body, such as along the inner thigh. Existing compressive clothing may compound these issues by locating seams in areas overlying more sensitive skin, e.g., by having seams running vertical along the inner thigh. In such cases, both the wearer's natural leg movement as well as friction between adjacent pieces of clothing may cause the seam to rub against the leg, leaving that area susceptible to irritation.

What is needed is a garment that preferably addresses one or more of these concerns.

SUMMARY OF THE INVENTION

In one aspect of the disclosure, a garment includes a base layer and an outer layer. The outer layer may extend around less than an entire circumference of the garment. Additionally, the outer layer may include a periphery and may be coupled to the base layer at less than an entirety of the periphery. Further, the base layer may include a compressive material. More specifically, the base layer at the portion of the entire circumference about which the outer layer does not extend may be configured to lay flat against a wearer's skin. The base layer may be substantially seamless and include a first, seamless leg portion and a second, seamless leg portion coupled by a seam. The outer layer may include a first portion disposed on a front side of the garment and a second portion disposed on a back side of the garment, and may be coupled to the base layer using seam tape. Furthermore, the outer layer may extend downwards from an area proximate a waist portion of the garment, but may not cover lateral sides of the garment between the first portion and the second portion.

In another aspect of the disclosure, a garment includes a base layer including a compressive material, an outer layer positioned outward of at least a portion of the compressive material, and seam tape coupling the outer layer to the base layer. The outer layer may be configured to cover less than an entire circumference of a wearer of the garment, and the base layer may extend around at least a portion of the circumference not covered by the outer layer. More specifically, the portion of the circumference not covered by the outer layer may include the wearer's lateral thigh regions. Further, the outer layer may include a periphery, and the seam tape may couple the outer layer to the base layer at less than an entirety of the periphery. The outer layer may further include a first portion disposed on a front side of the garment and a second portion disposed on a back side of the garment, and the base layer may include a first, seamless leg portion and a second, seamless leg portion coupled by a seam.

In still another aspect of the disclosure, a garment includes a base layer comprising a compressive material and an outer layer positioned outward of the base layer, the outer layer comprising a front side portion and a back side portion. The outer layer may be configured to cover a lateral thigh portion of at least one leg of the wearer's lower body. Conversely, the base layer may be configured to cover at least a portion of the lateral thigh portion. The base layer may include a first, seamless leg portion and a second, seamless leg portion coupled by a seam. Further, seam tape may couple the base layer to upper and lateral portions of the front side portion and the back side portion.

Figure 1:
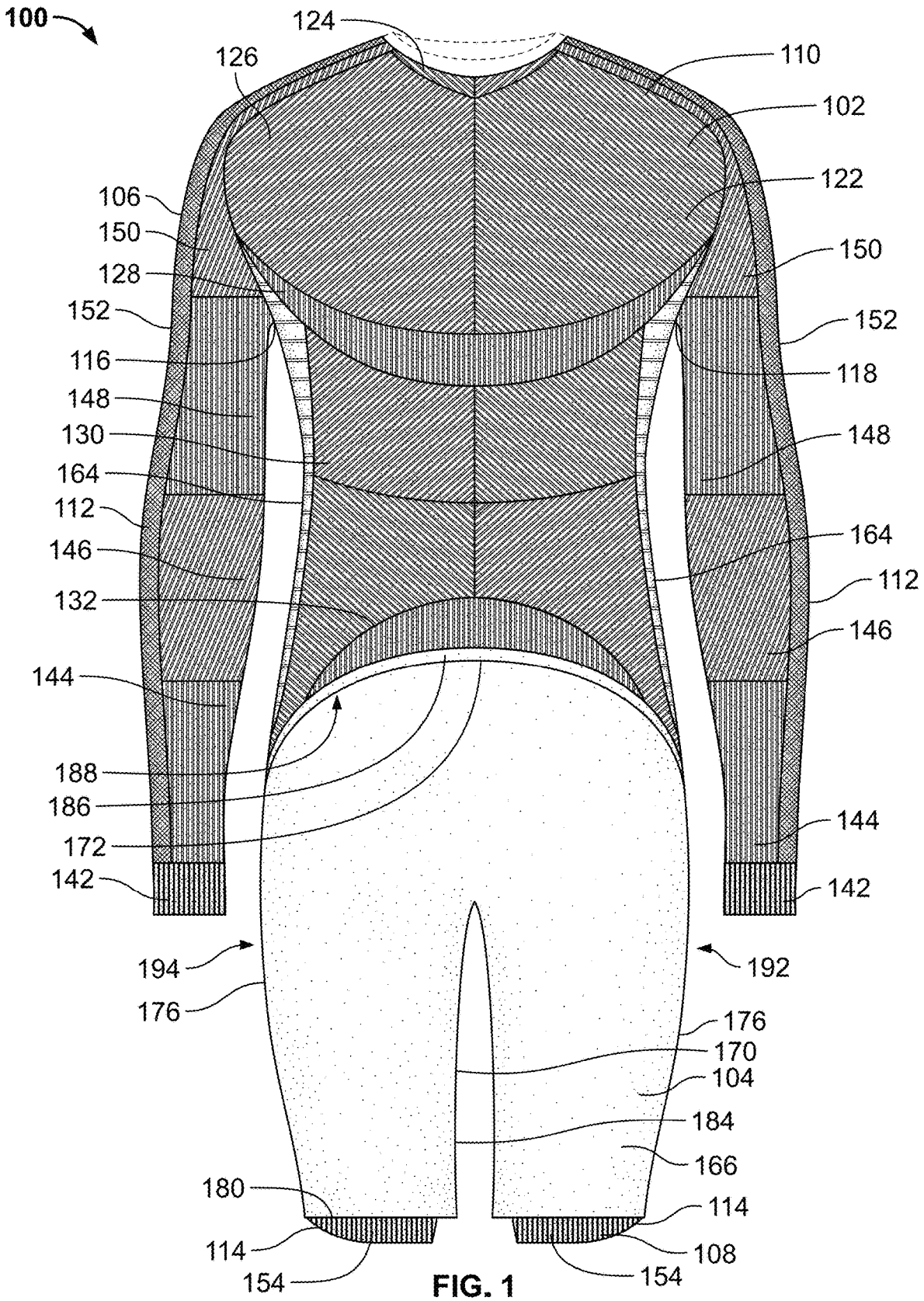
FIG. 1 is a front view of a garment including a base layer and an outer layer covering at least a portion of the base layer.
Figure 2:
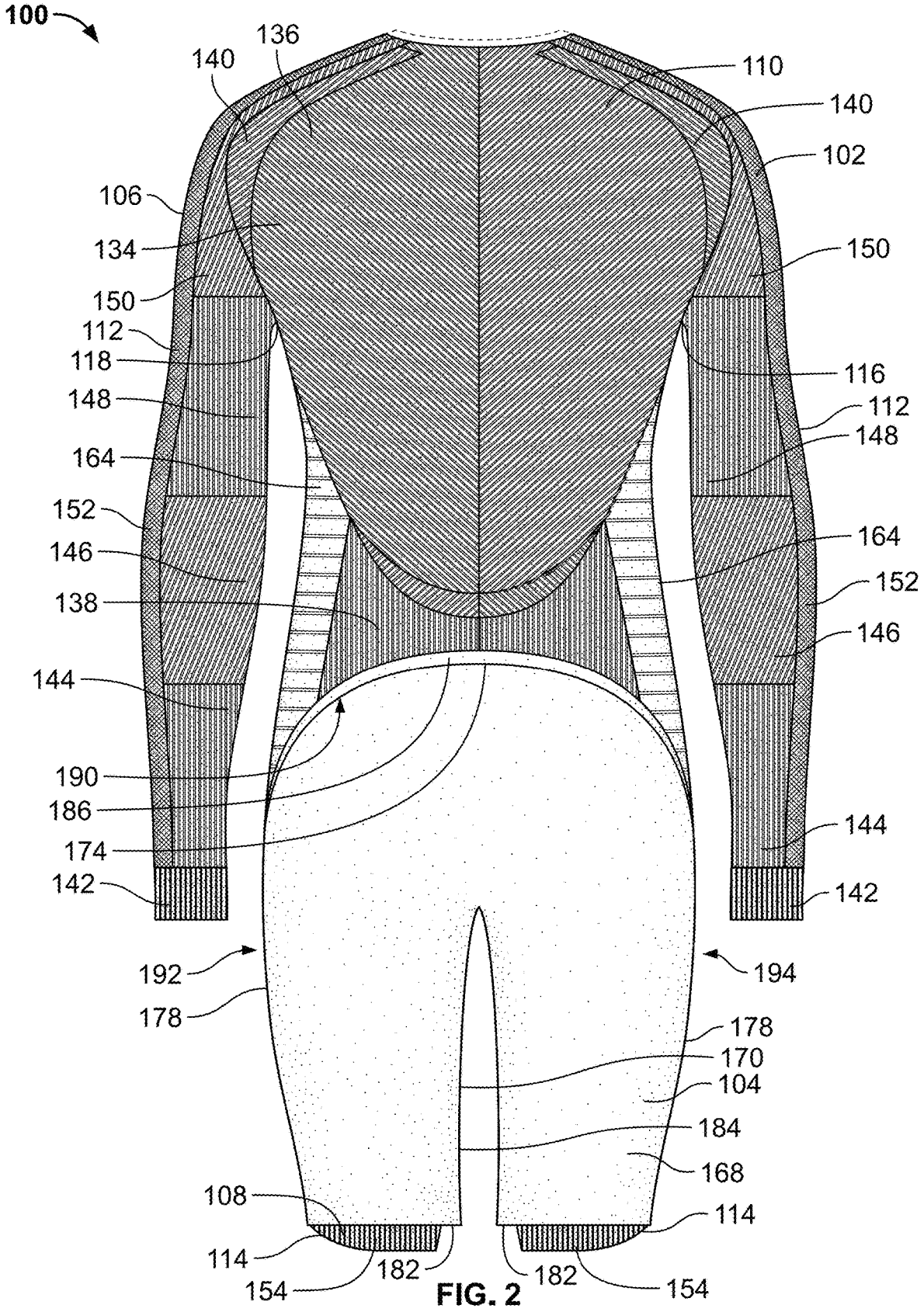
FIG. 2 is a rear view of the garment of FIG. 1.

Other aspects and advantages of the present invention will become apparent upon consideration of the following detailed description, wherein similar structures have similar references numerals.

DETAILED DESCRIPTION

Several aspects of the present invention are described herein with specificity to meet statutory requirements, but this description is not necessarily intended to limit the scope of the claims. The claimed subject matter may be embodied in other ways, may include different elements or steps, and may be used in conjunction with other existing or future technologies.

With reference to FIGS. 1-9, in one aspect, a garment 100 comprising a base layer 102 and an outer layer 104 is shown. As depicted, the outer layer 104 may be sewn, adhered, ultrasonically welded, bonded, or otherwise coupled to the base layer 102, thereby resulting in the garment 100 being a unitary structure. In certain other aspects, the outer layer 104 alternatively may be a separate garment worn over the base layer 102. The base layer 102 may include an upper section 106 covering the user's torso and potentially at least part of the user's upper extremities and a lower section 108 covering a portion of the user extending downward from the waist.

With regard to the specific garment 100 shown in these figures, and with particular reference to FIGS. 6-9, the base layer 102 includes a torso portion 110, one or more arm portions 112, and one or more leg portions 114. The base layer 102 may cover from the neck to above the knees of the user, including the entirety of the user's arms. In other aspects, however, the upper section 106 may cover less than the entirety of the arms, e.g., forming short sleeves, three-quarter sleeves, or no sleeves at all. In some aspects, the upper section 106 may cover the user's shoulders and substantially all of the user's trapezius, while in other aspects, the upper section may resemble a tank top and only cover a portion of the trapezius, leaving the shoulders uncovered. In still other aspects, the lower section 108 may extend down to a mid-thigh or to some location between the mid-thigh and above the knee. In yet other aspects, the lower section 108 may extend below the user's knee, e.g., to right below the kneecap, to mid-calf, to three-quarter calf, or to proximate the user's ankles. In other aspects, one or both of the upper section 106 and lower section 108 may comprise only one sleeve or leg portion, respectively. In yet other aspects, one sleeve or leg portion of the upper section 106 or lower section 108, respectively, may be longer than the other sleeve or leg portion. In still further aspects, the base layer may not comprise an upper section 106 or, alternatively, a lower section 108.

The upper section 106 and lower section 108 of the base layer 102 may be made as a unitary knitted design (i.e., the fabric is produced on a knitting machine as a unitary part substantially without seams). More specifically, the entire base layer 102 may be made as a substantially seamless textile article, without seams around substantially the whole circumference of the garment 100. A seamless section, "h,"

of the garment 100 extends at least along a part of the vertical extension "H" of the upper section 106 and the lower section 108. In one aspect, "h" may extend along at least 0.4 H, and in another aspect, "h" may extend along at least 0.5 H, or along at least 0.6 H, or along at least 0.7 H, or along at least 0.8 H.

In particular, each of the torso portion 110, the one or more arm portions 112, and the one or more leg portions 114 may, individually, comprise seamless structures. Thus, the only seams on the base layer 102 may be two sleeve seams 116, 118 and an inner leg seam 120. The sleeve seams 116, 118 connect the arm sleeves 112 to the upper section 106 of the base layer 102. The inner leg seam 120 is used to connect the two leg portions 114 to one another, wherein the remainder of the lower section 108 may be free from any seam. Thus, the mentioned leg seam 120 runs in a center plane of the garment 100 between the two adjacent leg portions 114.

Figure 3:
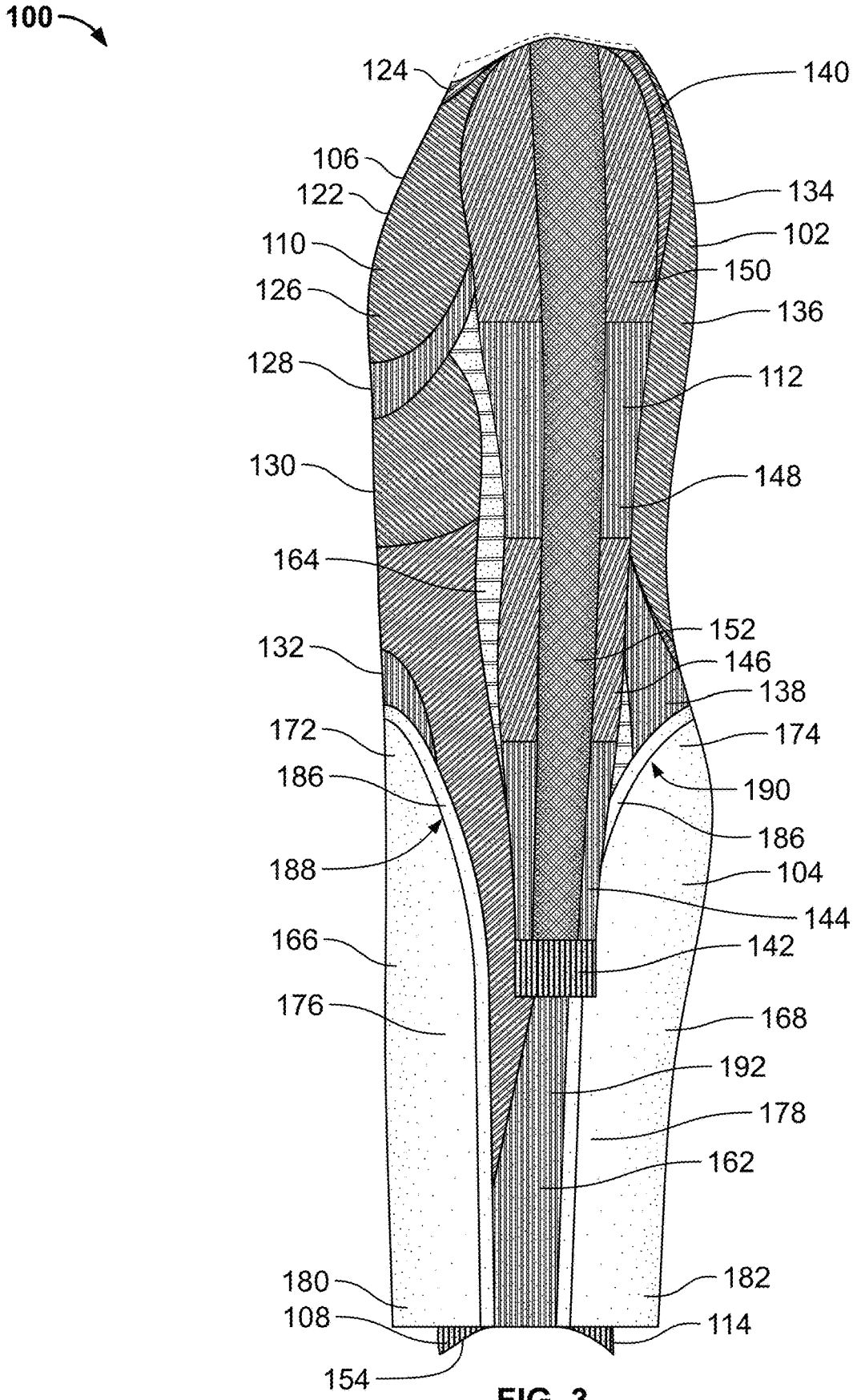
FIG. 3 is a side view of the garment of FIG. 1.
Figure 4:
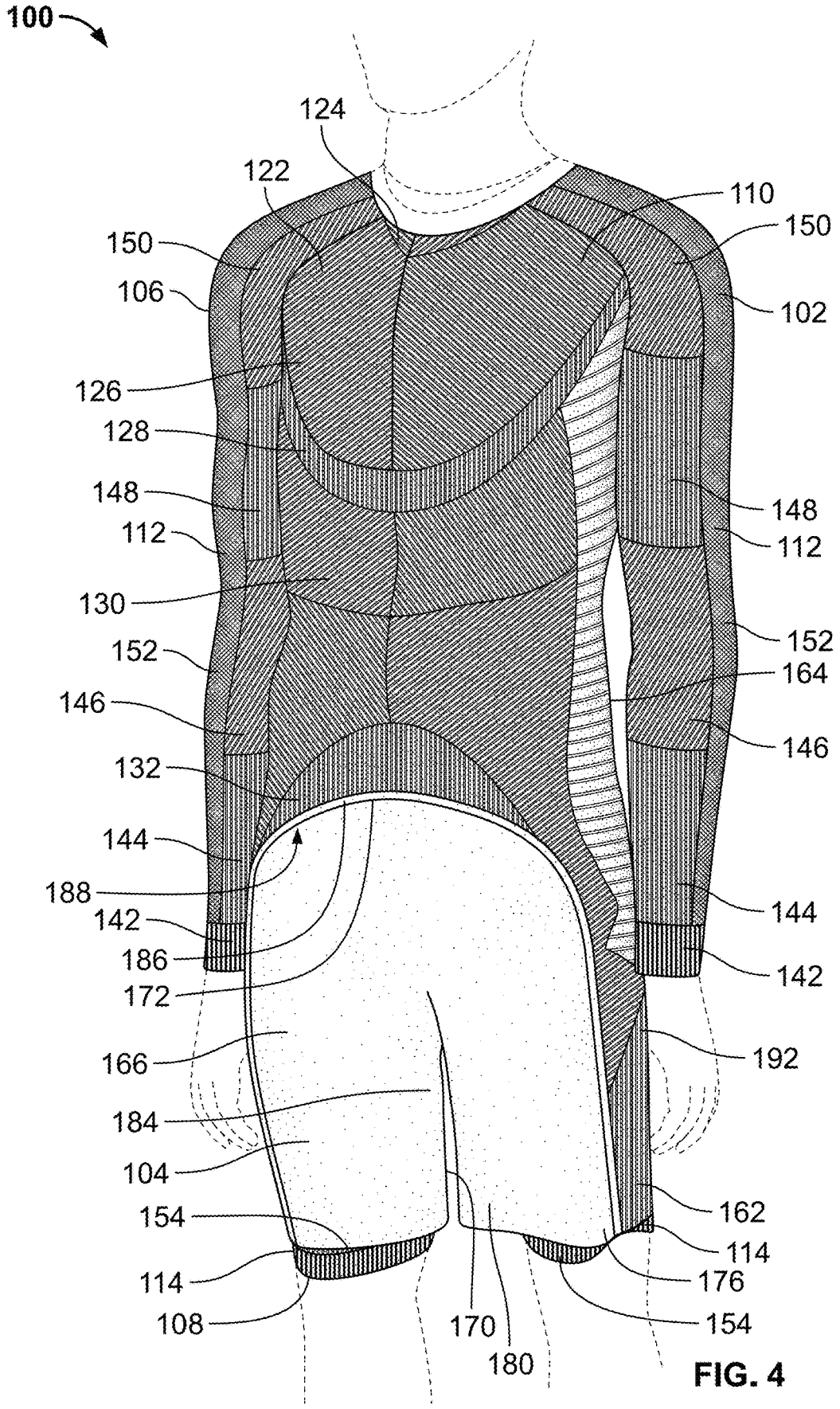
FIG. 4 is a front, isometric view of the garment of FIG. 1, displayed on the body of a person.

The base layer 102 is designed to form-fit the wearer's body, as best seen in FIGS. 3 and 4. In order to achieve this fit, the base layer 102 may be fabricated using weft or warp knitting methods; however, other methods may be used, as would be appreciated by one of ordinary skill in the relevant art. Further, to achieve a substantially seamless garment, circular knitting may be utilized. In another aspect, a flat knit may be utilized, although it may result in the garment including additional seams as compared to a garment using a circular knit.

The base layer 102, in addition to being substantially seamless, also may exhibit compressive characteristics. Compressive garments may improve endurance or aerobic performance by maintaining or enhancing blood flow in and reducing swelling of outer extremities. Commonly, compressive garments incorporate a pressure gradient, which may provide high pressure to distal ends of the extremities and low pressure to proximal ends of the extremities, thereby promoting return of blood to a wearer's heart. A fabric's compression is a measurement of force per unit of surface delivered by the fabric onto a surface, such as a wearer's muscles. This force is normally measured in millimeters of mercury (mmHg) or kilopascals (kPa). Alternatively, the stretch resistance may be defined by the quotient of a tension force (in Newtons) and the obtained elongation (in millimeters), i.e. in N/mm, measured by using a test strip with defined geometry (length and width) cut out of the knitted material. A test force is applied on this test strip and the elongation is measured to determine the stretch resistance accordingly.

Differing levels and gradients of compression may be used for different purposes. For example, a first garment may be designed to be worn for medical compression purposes, while a second garment may be design to provide sports or athletic grade compression. In either case, the garment may be designed with panels providing a graduated degree of compression, increasing from a core to an extremity portion of the garment. Medical grade compressibility may involve higher absolute compression values at both a core end and an extremity end of a compression region than sports grade compressibility, as well as a larger difference in compression as between the two ends. For example, in a garment with a leg portion configured to provide compression from an upper thigh region to an ankle such as the garment of FIGS. 2-18 (discussed in greater detail below), sports grade compression may be graduated from about 10 mmHg to about 25 mmHg, whereas medical grade compression may be graduated from about 16 mmHg to about 35 mmHg. Additionally, differences in compression levels in adjacent regions in a garment providing sports grade compression may be larger proximate the core end, diminishing towards the extremity end. Conversely, differences in compression levels in adjacent regions in a garment providing medical grade compression may be comparatively small proximate the core end, increasing towards the extremity end.

To achieve compressive characteristics, the base layer 102 may be made out of a suitable material, such as nylon, carbon, polyurethane, polyester, cotton, aramid, polyethylene, polypropylene, spandex, elastane, or any other appropriate material or blend thereof, as would be appreciated by one of ordinary skill in the relevant art. As a non-limiting example, a portion of the base layer 102 may comprise 50 denier (50 D)/72 filament (72 F)/2 ply polyester, and another portion thereof may comprise 33 deci-tex (33 dtex)/34 F/1 ply nylon and/or 17 dtex/20 F/1 ply spandex.

Furthermore, the base layer 102 may include differentiated stretch areas placed according to specific body mapped criteria with the aim to enhance comfort and/or mobility. That is, the compressibility may not be homogenous along the whole surface of the base layer 102. Instead, in regions where more movement is expected, the fabric may feature higher stretch and/or less compressibility, therefore enabling the wearer to move freely. In areas where less movement is expected, the fabric may feature lower stretch and/or greater compressibility, thereby providing higher support to certain muscles and enhancing blood flow.

Figure 6:
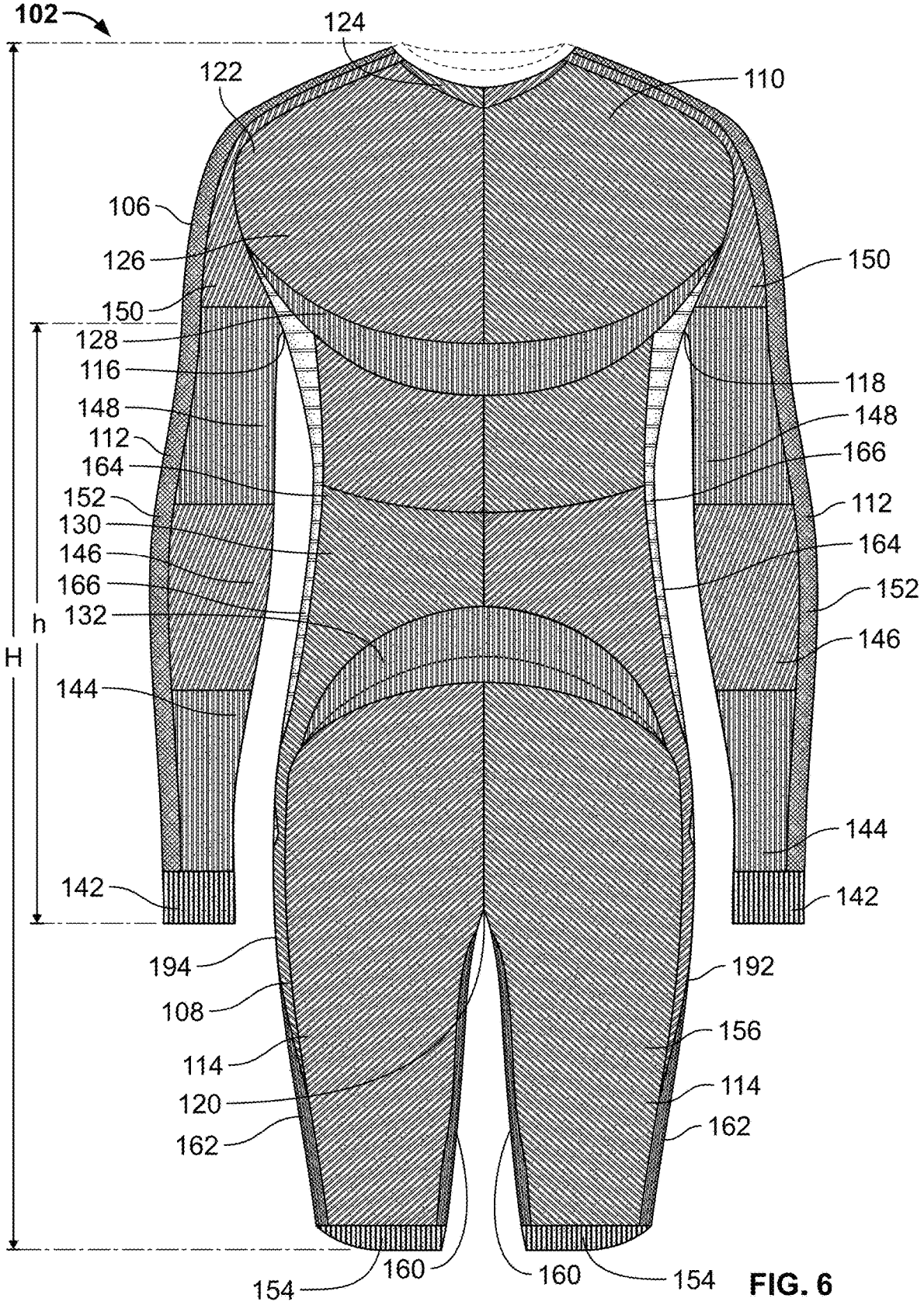
FIG. 6 is a front view of the base layer of the garment of FIG. 1.

For example, and with reference to FIG. 6, a front side 122 of the torso portion 110 of the base layer 102 may include a first region 124 around the neck area in which the knitted material has a defined first stretch resistance, one or more second regions 126 in the upper chest area having a defined second stretch resistance, a third region 128 below the second region 126 having a defined third stretch resistance, one or more fourth regions 130 below the third region 128 and in the abdominal area having a defined fourth stretch resistance, and one or more fifth regions 132 below the fourth regions 130 and in the waist area having a defined fifth stretch resistance. Adjacent regions may have different stretch resistances, e.g., the third stretch resistance may be different as compared to both the second and fourth stretch resistances. Non-adjacent regions may have the same or different stretch resistances as compared to one another. For example, the second stretch resistance may be the same as the fourth stretch resistance but different from the fifth stretch resistance or it may be different from both the fourth and fifth (as well as the third) stretch resistances. Similarly, the fifth stretch resistance may be the same as the third stretch resistance but different from the second stretch resistance.

In one particular example, a first stretch resistance may be lower than the stretch resistance of each of the other stretch resistances. The third stretch resistance may be below about 85% of the second stretch resistance and, more specifically, below about 70% of that second stretch resistance. The fourth stretch resistance may be between the second and third stretch resistances. The fifth stretch resistance may be substantially the same as the third stretch resistance.

Further, the stretch resistances of the base layer 102 may be customizable, providing different absolute degrees of compression for one or more regions, as well as specific differences in compression between adjacent regions, irrespective of the absolute values of those regions' compression. That is, the stretch resistance or compressive characteristics of specific areas of the base layer 102 may be tailored to an individual. By personally selecting the stretch resistance or compressive characteristics of areas of the base layer 102, comfort and performance may be enhanced.

In addition to having different stretch resistances, the different regions of the base layer 102 may have different sizes and/or shapes as compared to one another. For example, the third region 128 and the fifth region 132 may comprise substantially less surface area than either or both of the second region 126 or the fourth region 130. Both the third and fifth regions 128, 132 may be crescent-shaped, although the third region 128 may be concave when viewed from the top-down while the fifth region 132 may be convex when similarly viewed. It will be understood that these configurations are exemplary and that alternative sizes and/or shapes for one or more of the regions of the base layer 102 may be employed.

Figure 7:
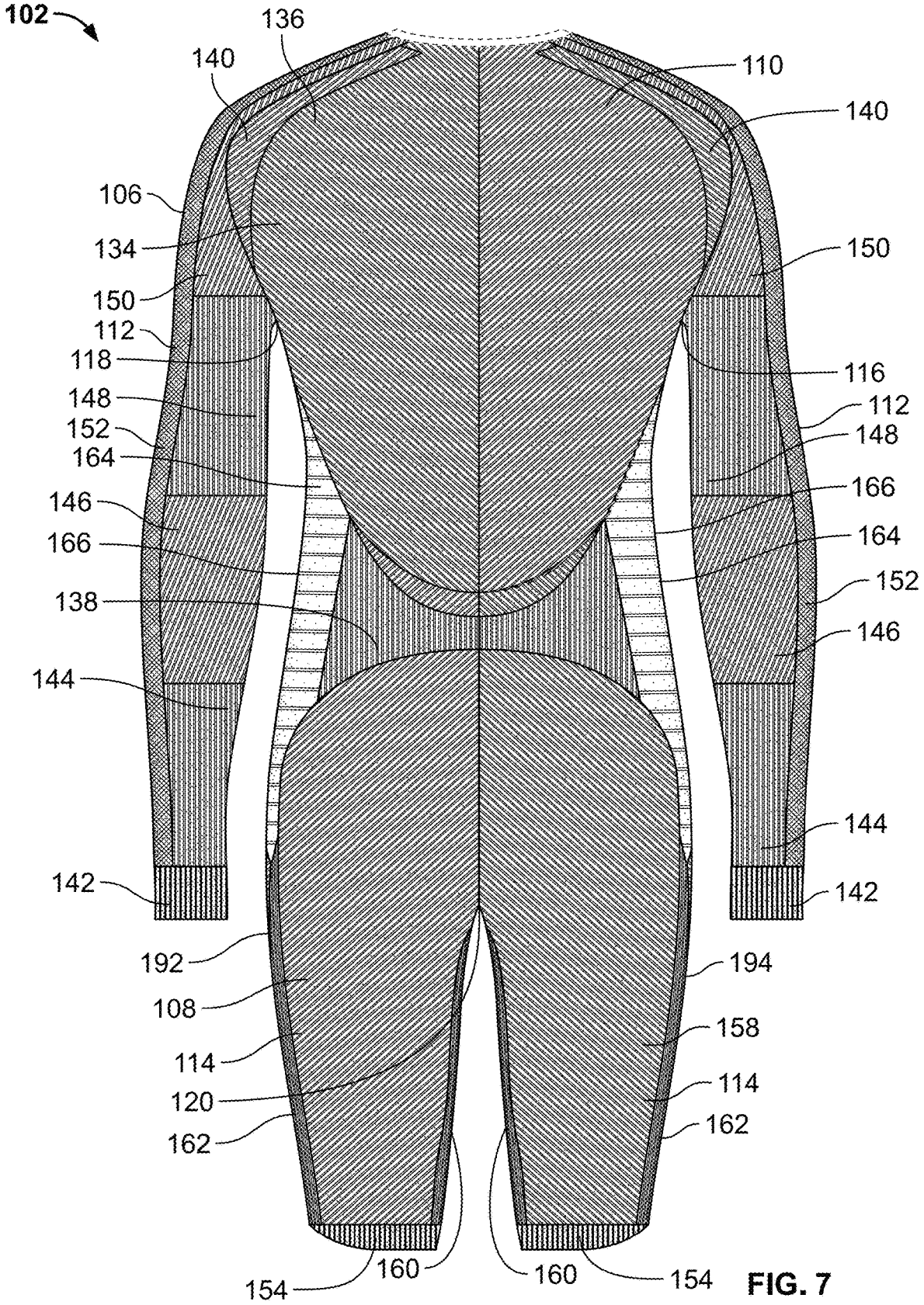
FIG. 7 is a rear view of the base layer of the garment of FIG. 1.
Figure 8:
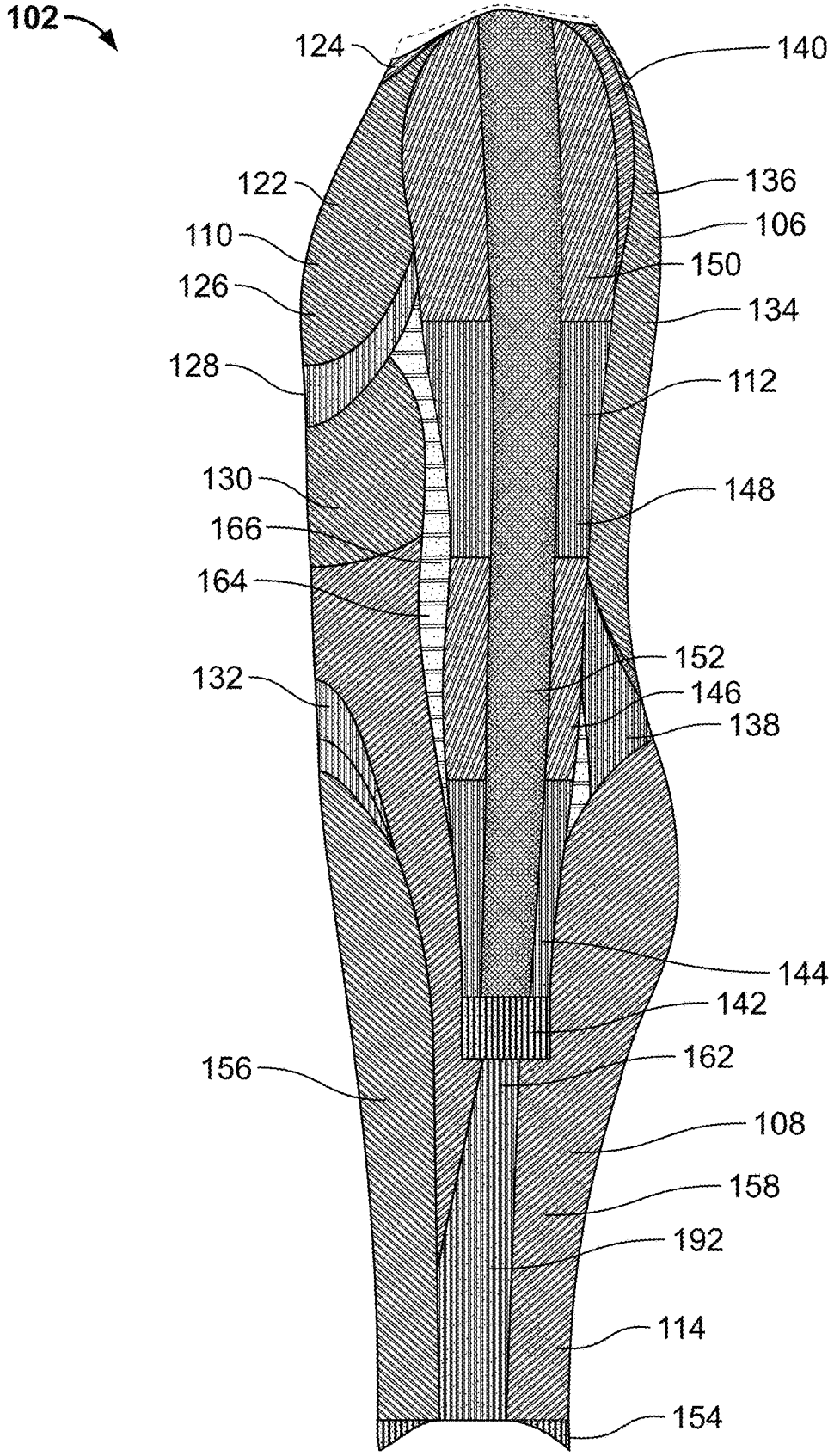
FIG. 8 is a side view of the base layer of the garment of FIG. 1.

Similarly, and with reference to FIG. 7, a back side 134 of the torso portion 110 may include one or more regions of stretch resistance. For example, a first region 136 comprising a majority of the back side 134 may have a first stretch resistance, a second region 138 extending about the lumbar region of the lower back may have a second, different stretch resistance, and one or more third regions 140 in the scapular region of the back may have a third stretch resistance, where the third stretch resistance may be the same as or different from the second stretch resistance.

Referring again to FIGS. 6-9, both the arm portions 112 and leg portions 114 similarly may include multiple regions of stretch resistance. For example, one or both of the arm portions 112 may include a first region 142 of stretch resistance around the wrist, a second region 144 of stretch resistance extending upward from the first region 142 to a location below the elbow, around a medial portion of the forearm, a third region 146 of stretch resistance extending upward from the second region 144 to a location above the elbow, around a medial portion of the elbow, a fourth region 148 of stretch resistance extending upward from the third region 146 to a location proximate the armpit, along the triceps, a fifth region 150 of stretch resistance extending upward from the fourth region 148 to a location proximate the collarbone in the front and proximate the scapula in the rear, and a sixth region 152 of stretch resistance extending laterally down the arm from the neck to the wrist.

Similarly, one or both of the leg portions 114 may include a first region 154 of stretch resistance along the bottom of the leg portion, a second region 156 of stretch resistance extending along an anterior portion of the leg, along the quadriceps and between the fifth region 132 of the torso portion 110 and the first region 154 of the leg portion, a third region 158 of stretch resistance extending along a posterior portion of the leg, along the hamstrings and gluteal muscles, between the second region 138 of the back side 134 and the first region 154 of the leg portion, a fourth region 160 of stretch resistance extending upward from the first region 154 along each inner thigh, and a fifth region 162 of stretch resistance extending upward from the first region 154 along the outer thigh. In one aspect, the fifth region 162 may be continuous with and/or an extension of the fourth region 130 of stretch resistance of the torso portion 110.

In addition to the selective stretch resistances, FIGS. 6-9 show designated regions of increased breathability integrated in the unitary base layer 102. For instance, two such areas of increased breathability 164 may extend along each side 166 of the base layer, between the front side 122 and the back side 134. The areas of increased breathability 164 may be made of the same or a different material as one or more of the regions of stretch resistance in the base layer 102 and instead may include one or more openings in the form of woven openings, laser slits, etc., in order to facilitate airflow through the base layer 102 and away from the wearer's body. Additionally or alternatively, the areas of increased breathability 164 may be woven to be less dense than the regions of stretch resistance or may be woven to define openings in the material forming those areas.

In addition to, or instead of one or more of the areas of stretch resistance and/or the regions of increased breathability, designated regions of the unitary base layer 102 may be designed to provide warming characteristics to a wearer. More specifically, selected areas of the base layer 102 may use higher denier yarns, implement a denser knit, or use different materials than other regions of the fabric to provide enhanced warming characteristics. For example, the second region 156 may include a yarn with a higher denier count than a yarn used to make the fifth region 162.

Different materials and/or knitting techniques may be employed to provide varying fit, breathability, and/or warming characteristics to different parts of the base layer 102. For example, a seamless circular knitting process may be employed to produce a body fit in the upper section 106 and a slim fit in the lower section 108. Alternatively, the seamless circular knitting process can also be employed to obtain a slim fit for the whole base layer 102 of the garment 100, or a seamless warp knitting process may be used to obtain a body fit for the whole base layer 102.

Similarly, within each of the various portions of the base layer 102, different materials or different manufacturing techniques may be employed to provide different stretch resistances in certain regions of the embodiments of the base layer 102. Different techniques may be employed to provide those different stretch resistances, including, altering a knit density as between different sections in the base layer 102, using different materials in adjacent sections, and/or employing different knitting techniques.

One or more zippers (not shown) can be arranged on the base layer 102 to facilitate pulling on and taking off of the garment 100. For example, with regard to the garment shown in FIGS. 1-9, the base layer 102 of the garment 100 may include three concealed zippers, two on the shoulders 142, 144 and one positioned at the front fly 148. In another aspect, the base layer 102 of the garment 100 may have a concealed zipper disposed along the inner thigh seam. In still another aspect, the base layer of the garment may have a concealed zipper disposed along one side of the torso and another zipper located at the front fly.

Returning to FIGS. 1-5, the outer layer 104 may be permanently attached or secured to the base layer 102. In the example shown in these figures, the outer layer 104 comprises a first piece 166 covering a portion of the front of the base layer 102 and a second piece 168 covering a portion of the rear of the base layer 102. In this regard, it should be appreciated that one or both of the first piece 166 and the second piece 168 may comprise multiple pieces of material joined together in one fashion or another. For example, one or both of the first piece 166 and the second piece 168 may comprise a first portion extending generally along one of the user's legs and a second portion extending generally along the other one of the user's legs. The first and second portions then may be connected to one another via stitching, adhesive, or some other means at one or more seams (not shown). The material defining the first and second pieces may have texture, such as laser slits, woven dots, or any other available details.

In one aspect, the first piece 166 and the second piece 168 each may be formed from a flat pattern, wherein the material forming the pattern may be knit, woven, or otherwise formed from other available materials using techniques that would be appreciated by one of ordinary skill in the relevant art. The first piece 166 and second piece 168 then may be connected together, e.g., by stitching or seam tape at a seam 170 that runs up an inseam of one of the leg portions and down the opposing inseam of the other leg portion. In some aspects, it may be necessary to manipulate the fabric to achieve shape stability. For example, the first piece 166, the second piece 168, and/or the base layer 102 may be heated or pressed prior to joining of the first and second pieces to the base layer to ensure the fabric shape of one or more pieces will not change.

Once formed and preferably but not necessarily after being connected to one another, the first piece 166 and second piece 168 may be joined to the base layer 102 around a portion of, and less than an entirety of, their peripheries. In particular, the first and second pieces 166, 168 may be joined to the base layer 102 at their upper ends 172, 174, respectively, as well as along their lateral sides 176, 178, respectively. As a result, the first and second pieces 166, 168 may not be joined to the base layer 102 along their lower ends 180, 182, or their (joined) medial sides 184. Notches and/or outlines on or in one or more of the base layer 102 and the outer layer 104 may be utilized to ensure the first and second pieces 166, 168 are aligned with the base layer 102 consistently. Additionally, in some aspects, the first and second pieces 166, 168 may be modified to avoid wrinkling during attachment. For example, the edges of the first and second pieces 166, 168 joined to the base layer 102 may be cut into convex shapes, thereby allowing the first piece 166 and second piece 168 to be attached to the base 102 without wrinkling.

In one aspect, seam tape 186 may be used to provide continuous attachment or bonding between each of the first and second pieces with the base layer 102 along their respective mating seams 188, 190. When applying the seam tape 186, heat may be applied to bond the fabric thereto. Additionally or alternatively, other methods of attachment such as stitching may be used along at least some of the seams 188, 190. For example, the first piece 166 and second piece 168 may first be stitched to the base layer 102, and then covered by the seam tape 186.

The first and second pieces 166, 168 may be sized so as to provide clearance between the base layer 102 and the open or lower ends 180, 182 of the outer layer 104. For example, the first and second pieces 166, 168 may be sized so as to provide between about 1 cm and 8 cm of maximum clearance between those elements, and preferably between about 2 and about 6 cm of clearance, although it will be recognized that the amount of clearance may vary depending on the size of the wearer's legs, as the base layer 102 is configured to expand to the contours of those legs while the outer layer 104 remains a generally constant size.

In addition, the lateral sides 176, 178 of the first and second pieces 166, 168 may be attached to the base layer 102 at locations along the front and rear of the base layer 102, respectively. As a result, the lateral portions 192, 194 of the wearer's thigh may be covered only by portions of the base layer 102 and not the outer layer 104, such that the garment 100 is snug against the wearer's skin in those regions.

Figure 5:
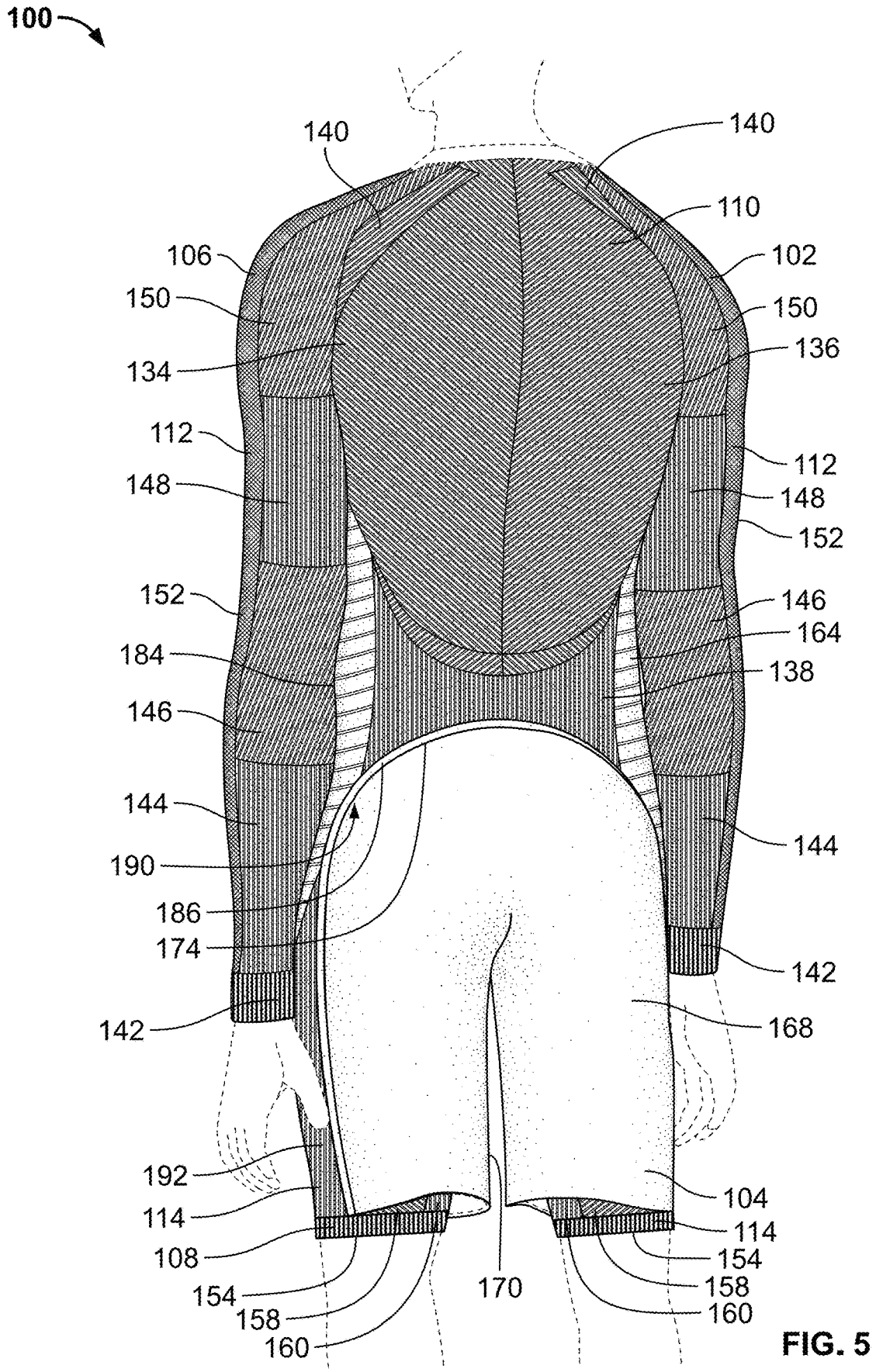
FIG. 5 is a rear, isometric view of the garment of FIG. 1, displayed on the body of a person.
Figure 9:
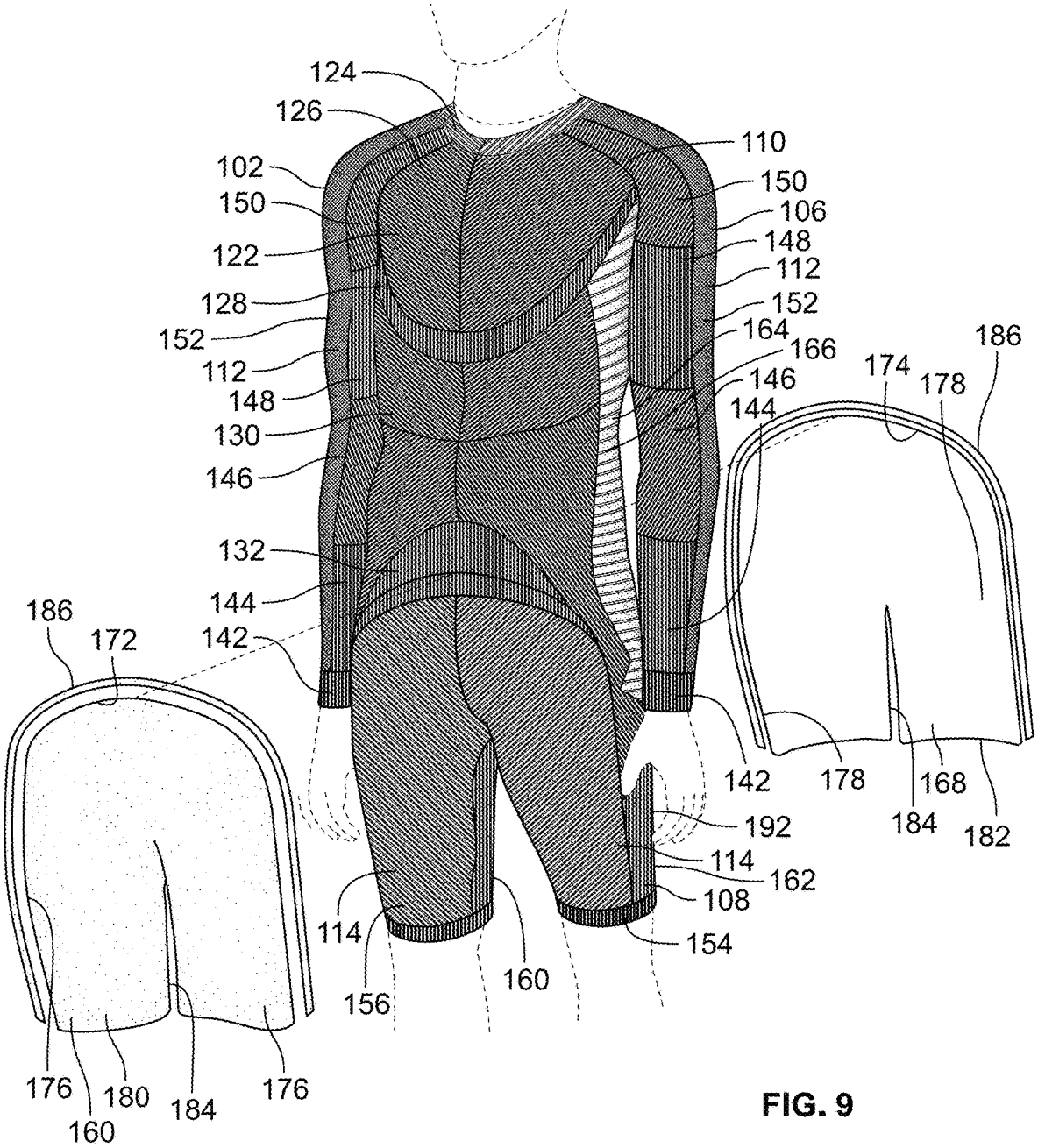
FIG. 9 is an isometric, exploded view of the garment of FIG. 1.
Figure 10:
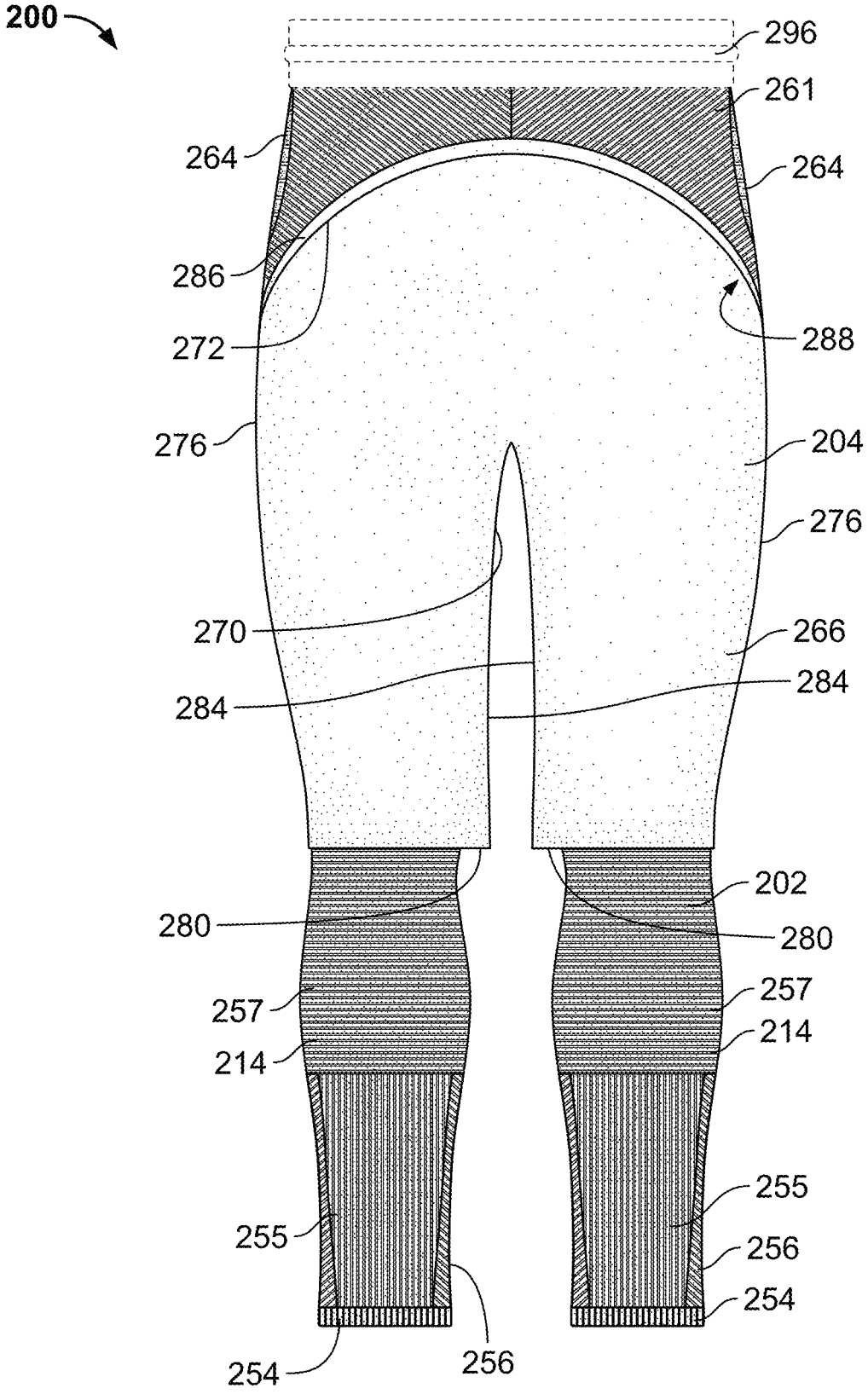
FIG. 10 is a front view of a second garment including a base layer and an outer layer covering at least a portion of the base layer.
Figure 11:
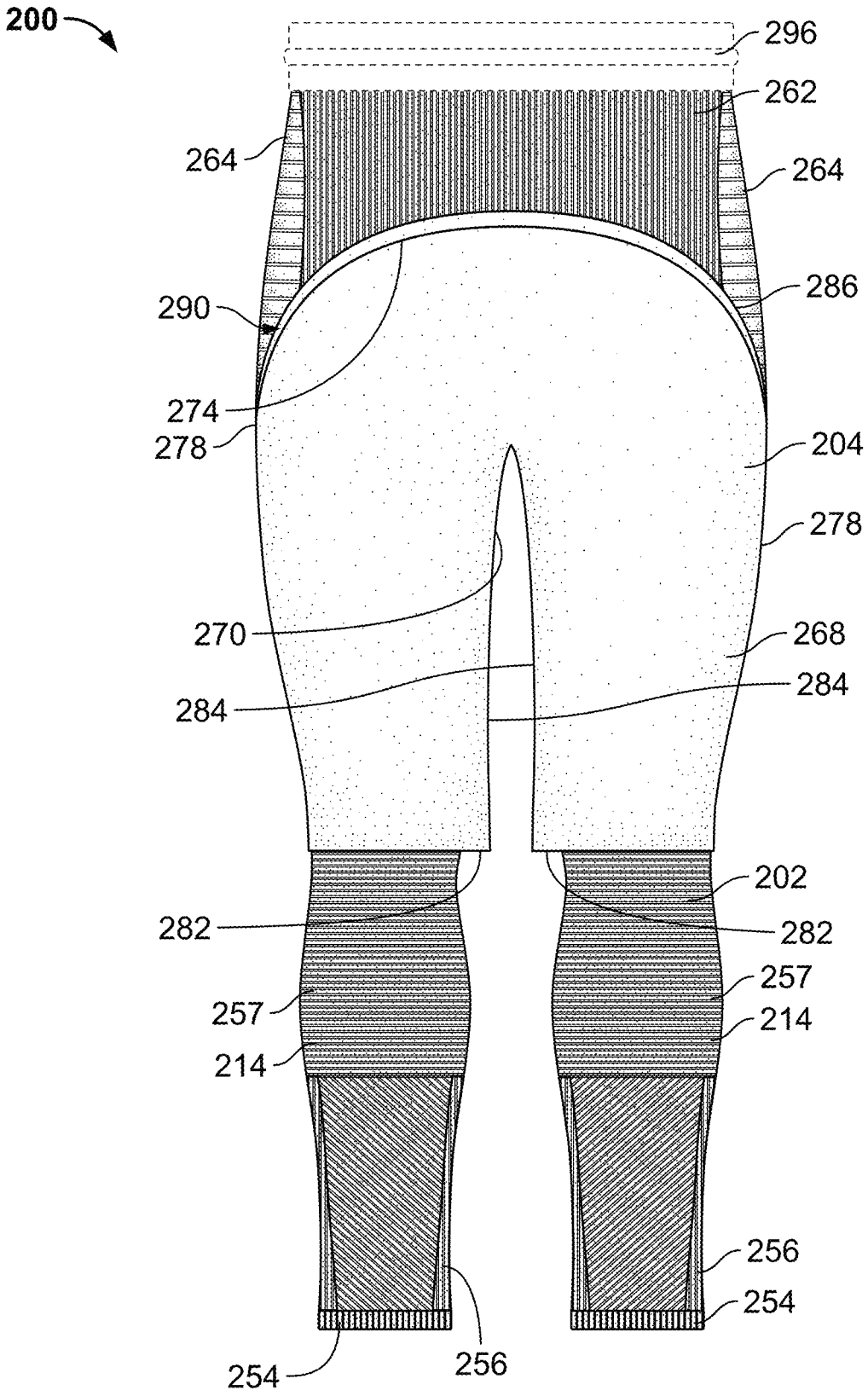
FIG. 11 is a rear view of the garment of FIG. 10.
Figure 12:
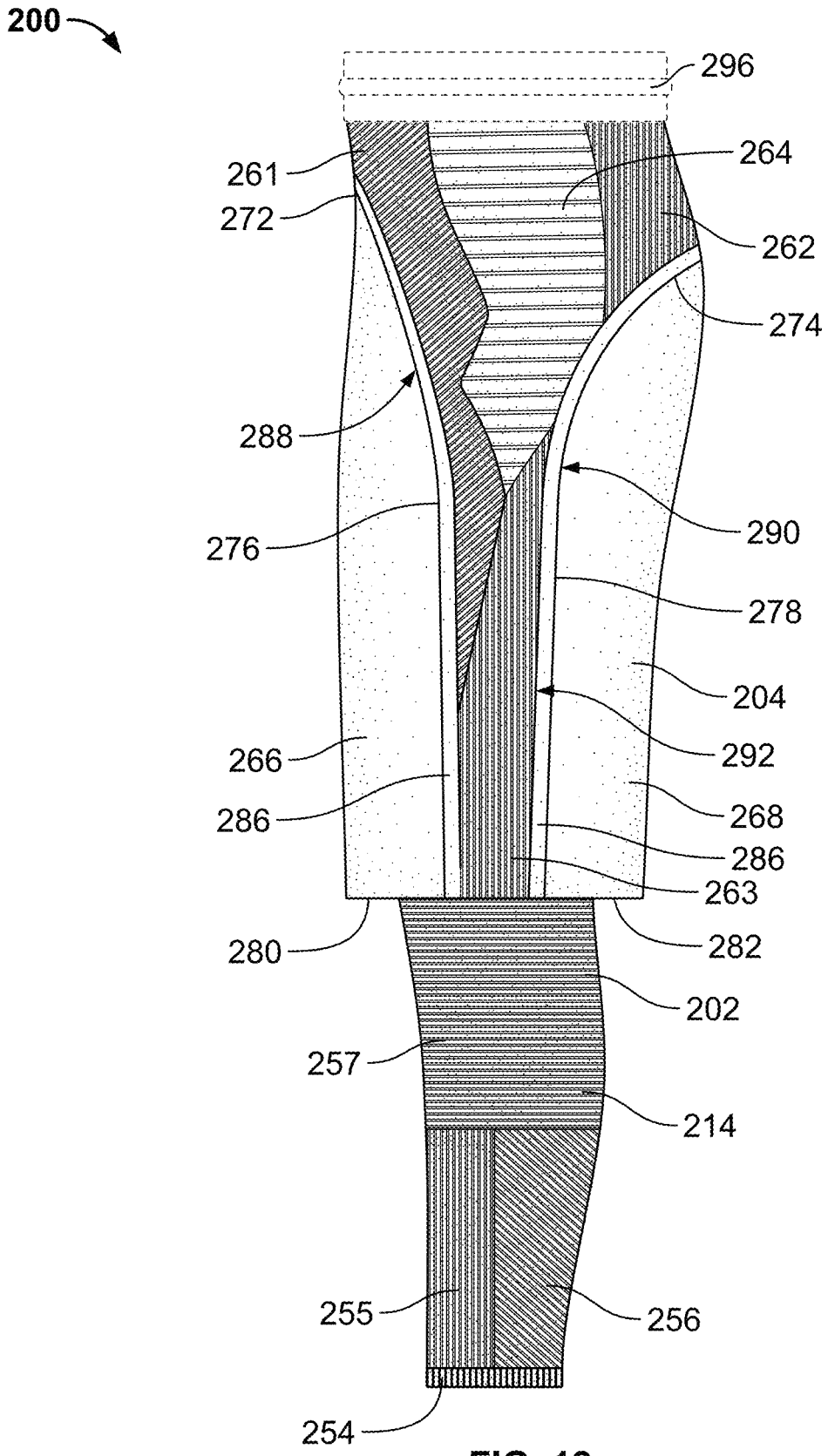
FIG. 12 is a side view of the garment of FIG. 10.
Figure 13:
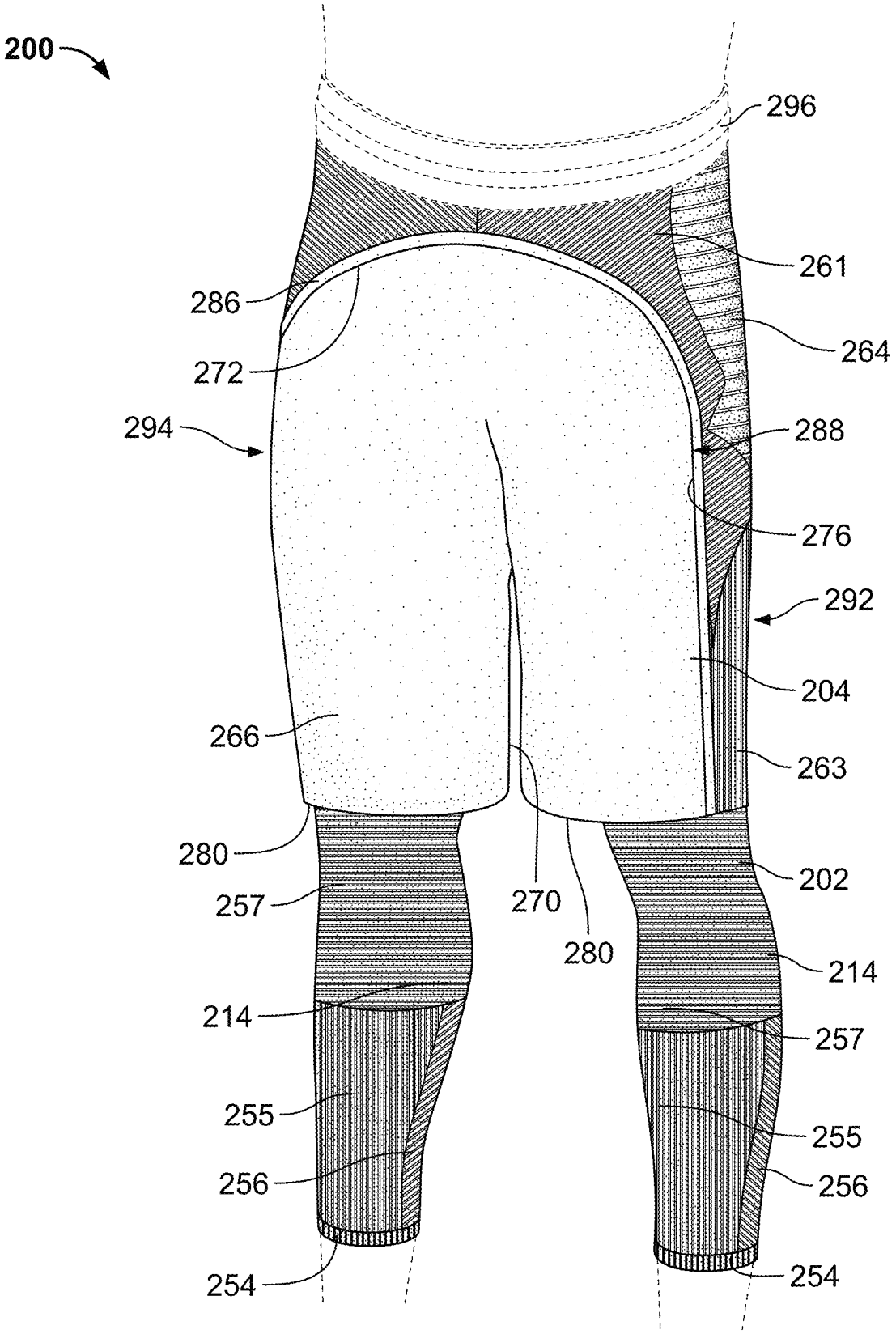
FIG. 13 is a front, isometric view of the garment of FIG. 10, displayed on the body of a person.
Figure 14:
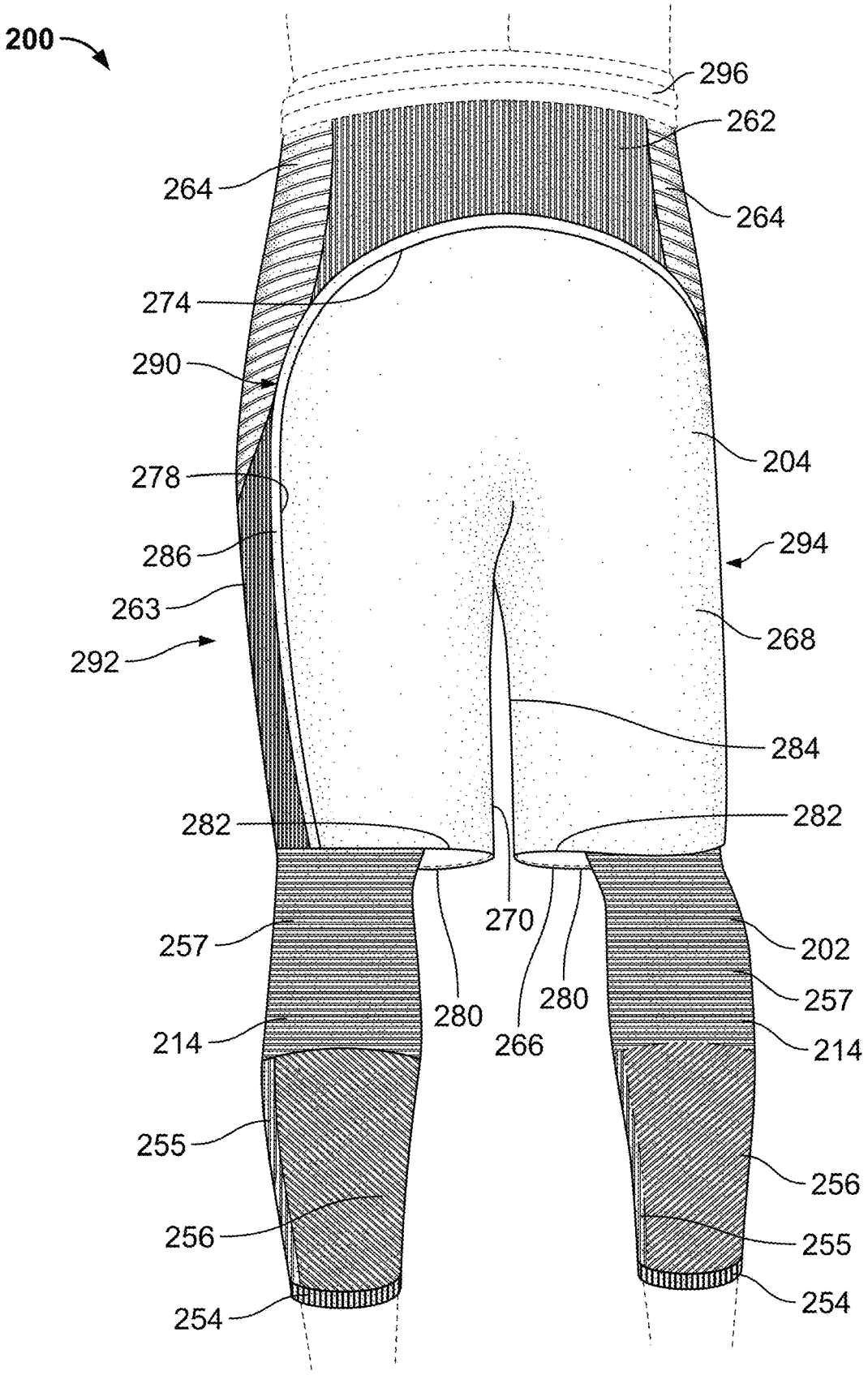
FIG. 14 is a rear, isometric view of the garment of FIG. 10, displayed on the body of a person.
Figure 15:
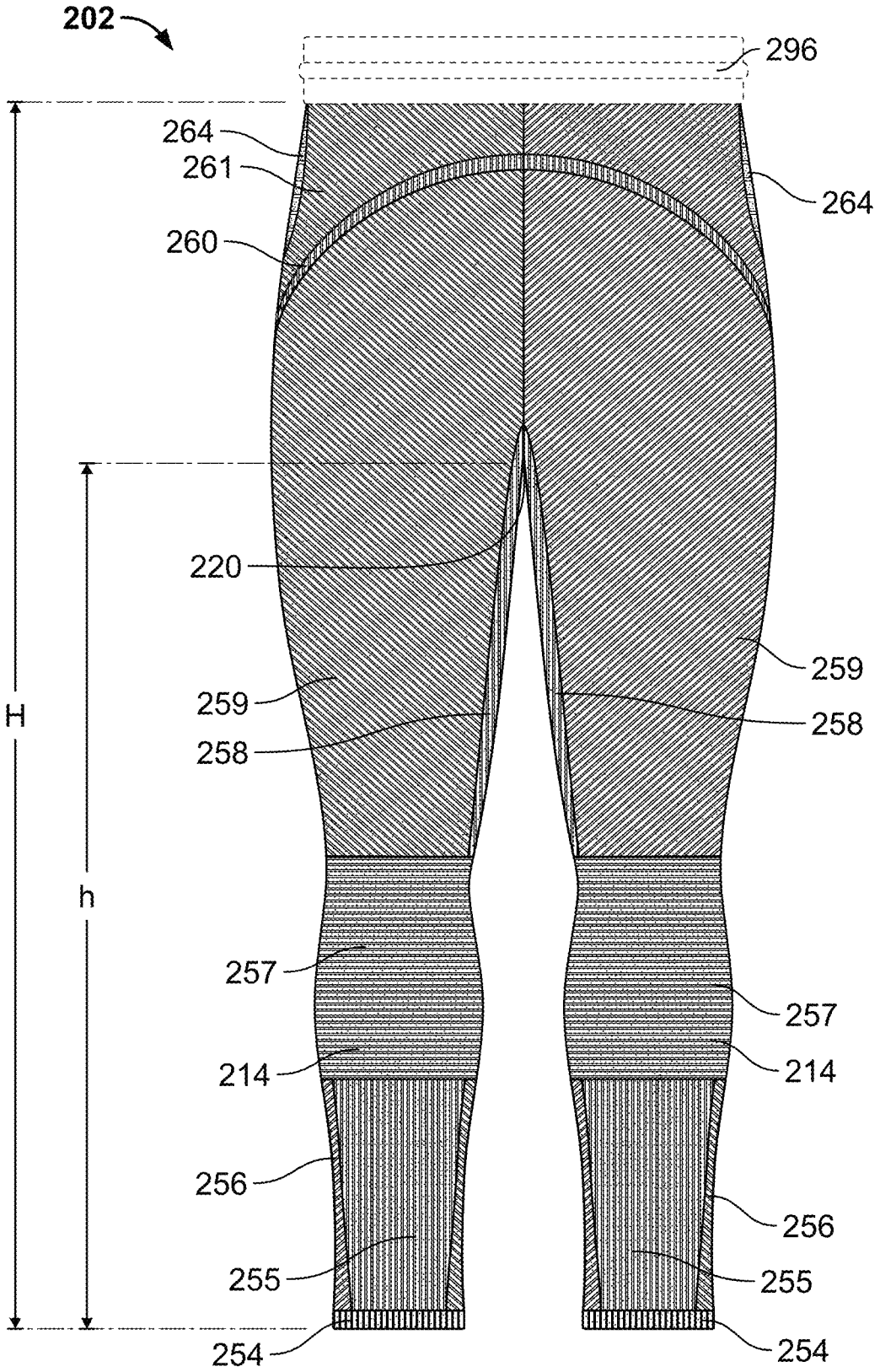
FIG. 15 is a front view of the base layer of the garment of FIG. 10.
Figure 16:
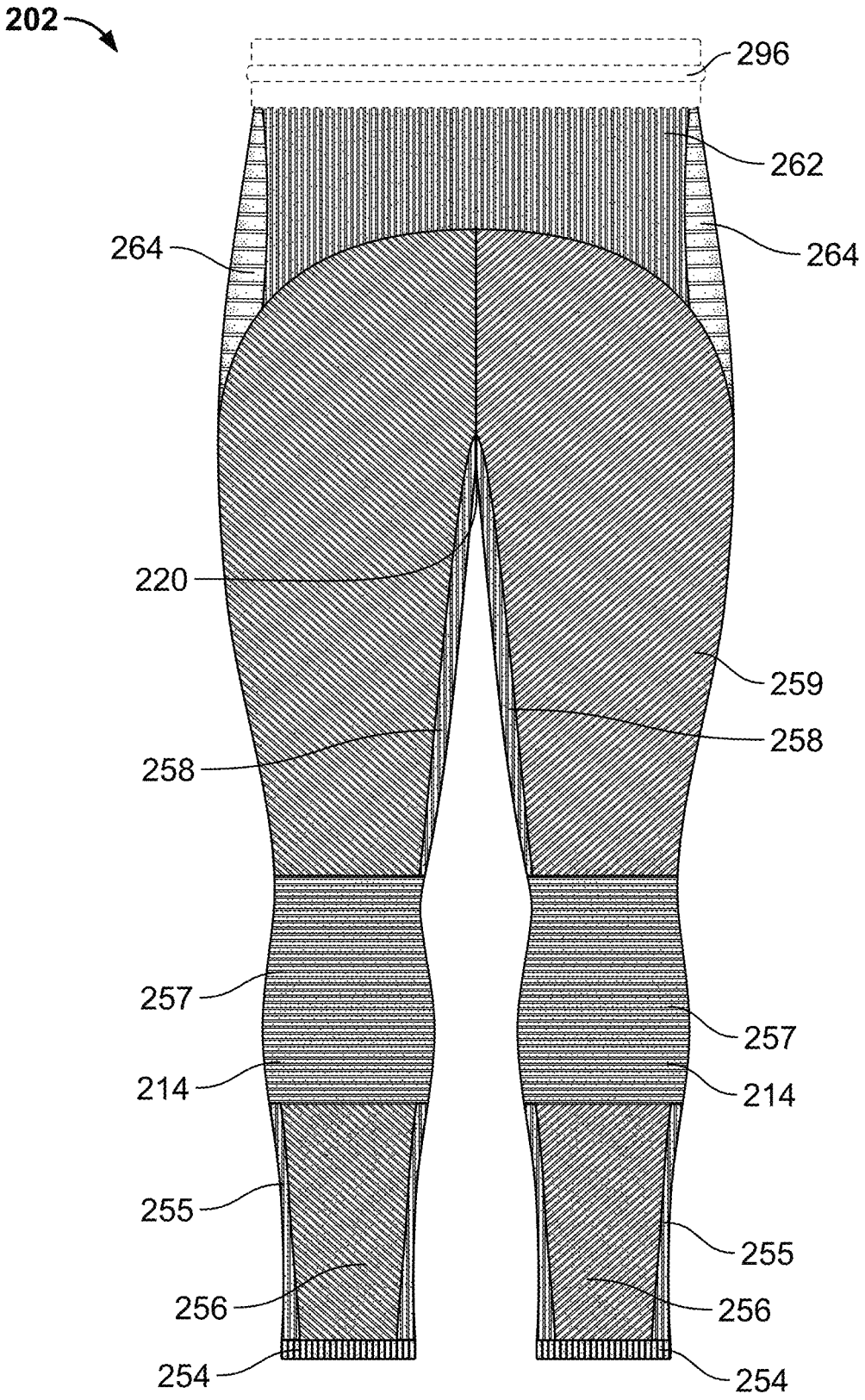
FIG. 16 is a rear view of the base layer of the garment of FIG. 10.
Figure 17:
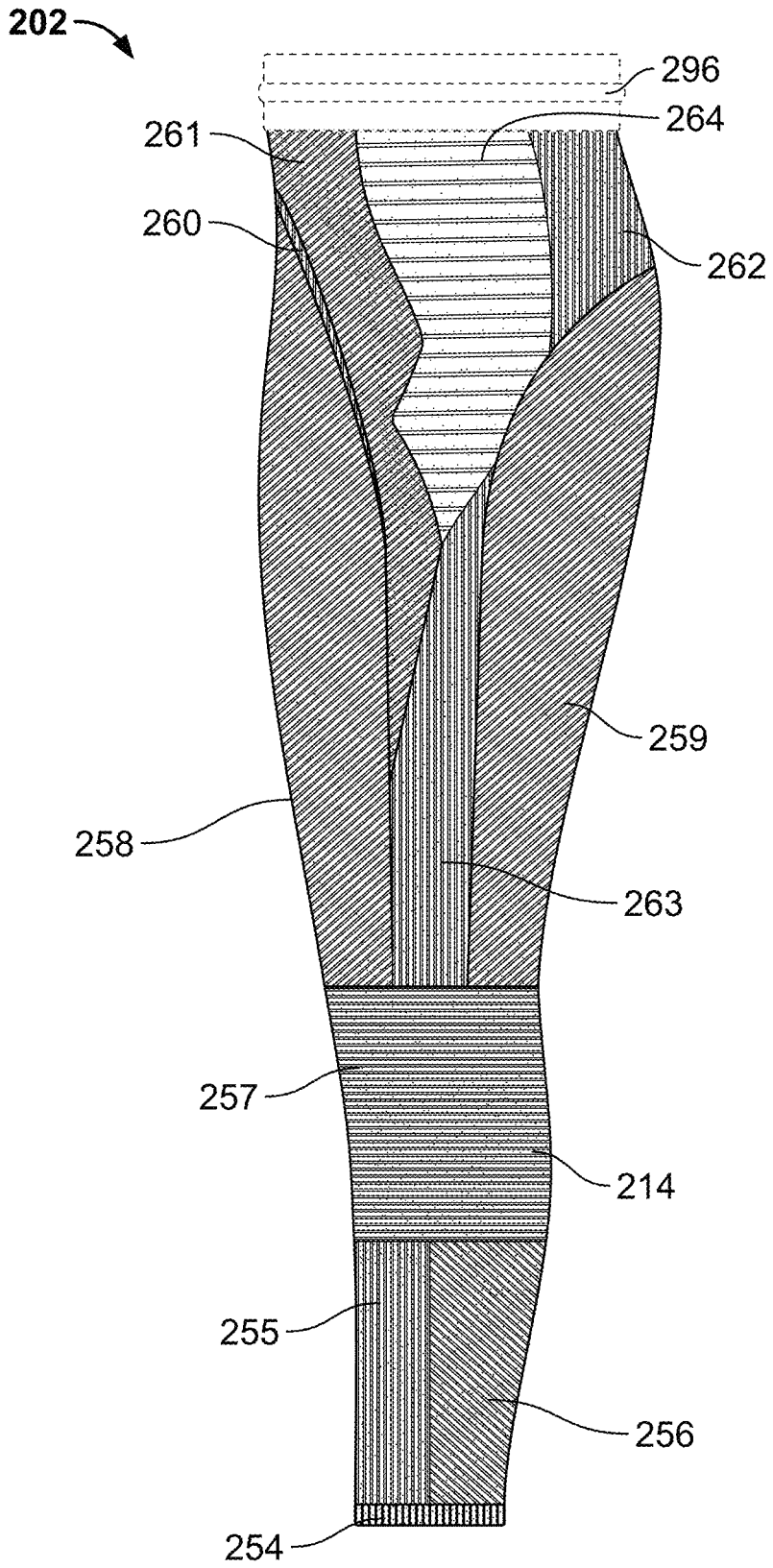
FIG. 17 is a side view of the base layer of the garment of FIG. 10.
Figure 18:
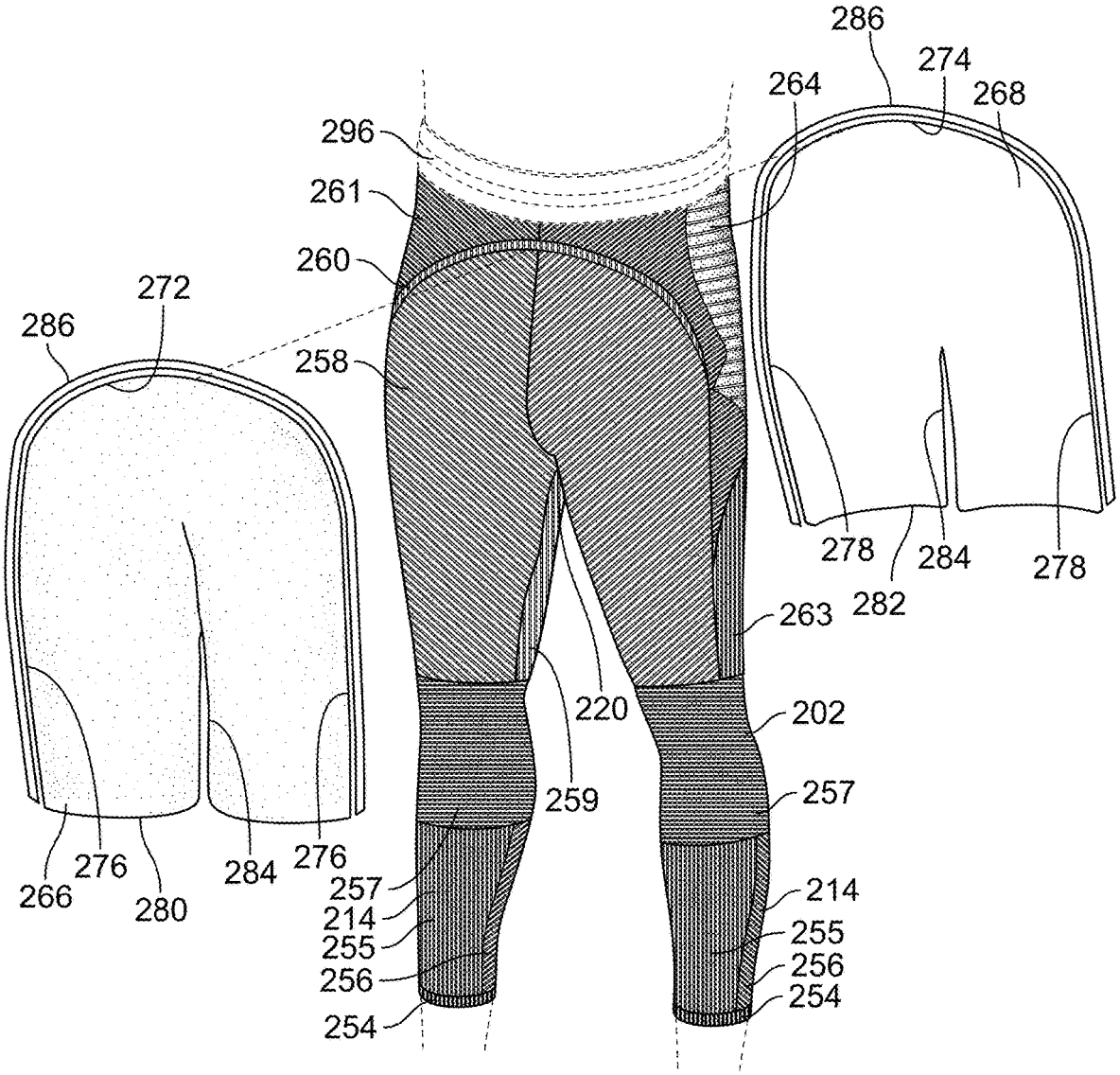
FIG. 18 is an isometric, exploded view of the garment of FIG. 10.
Figure 19:
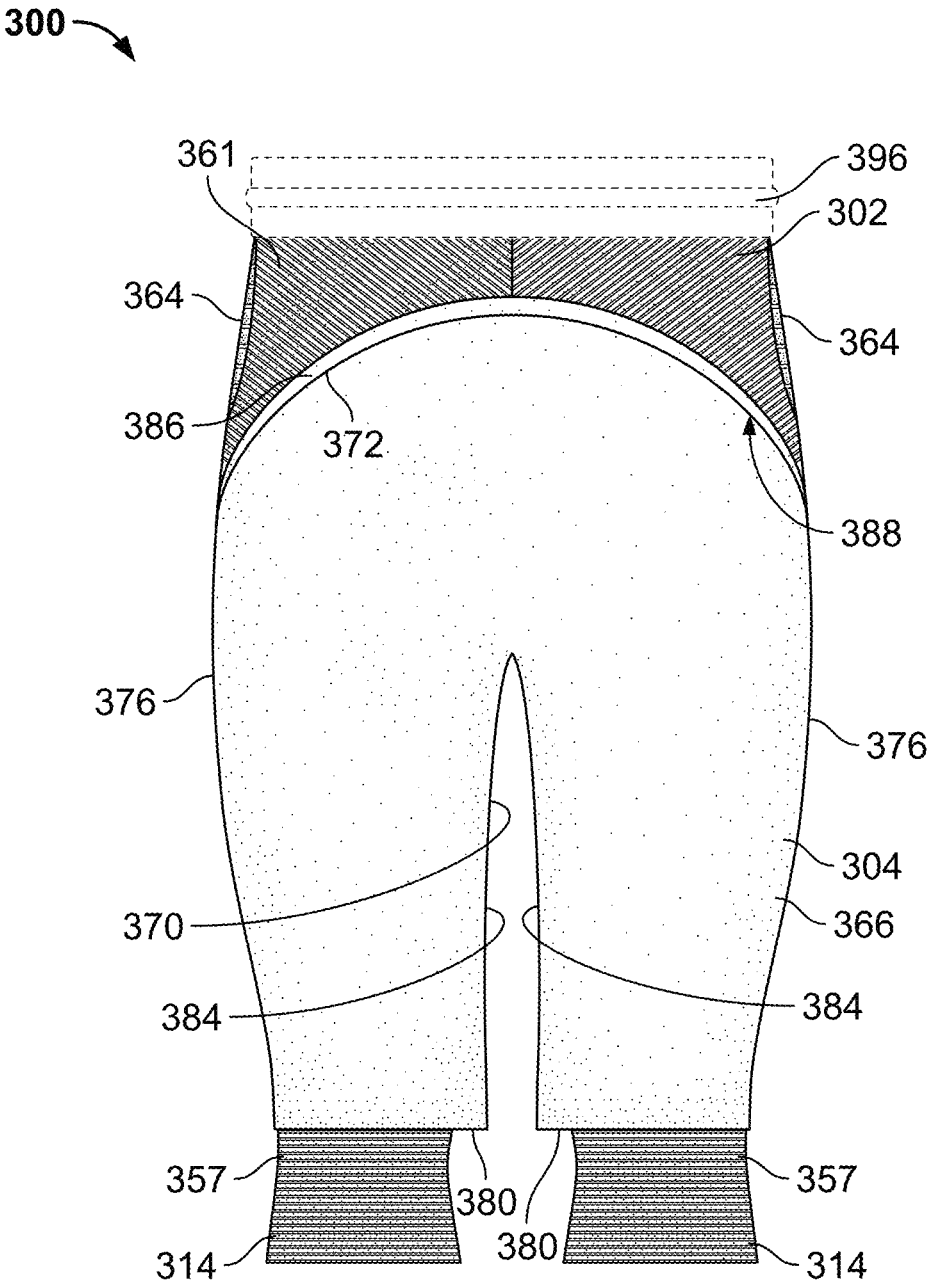
FIG. 19 is a front view of a third garment including a base layer and an outer layer covering at least a portion of the base layer.
Figure 20:
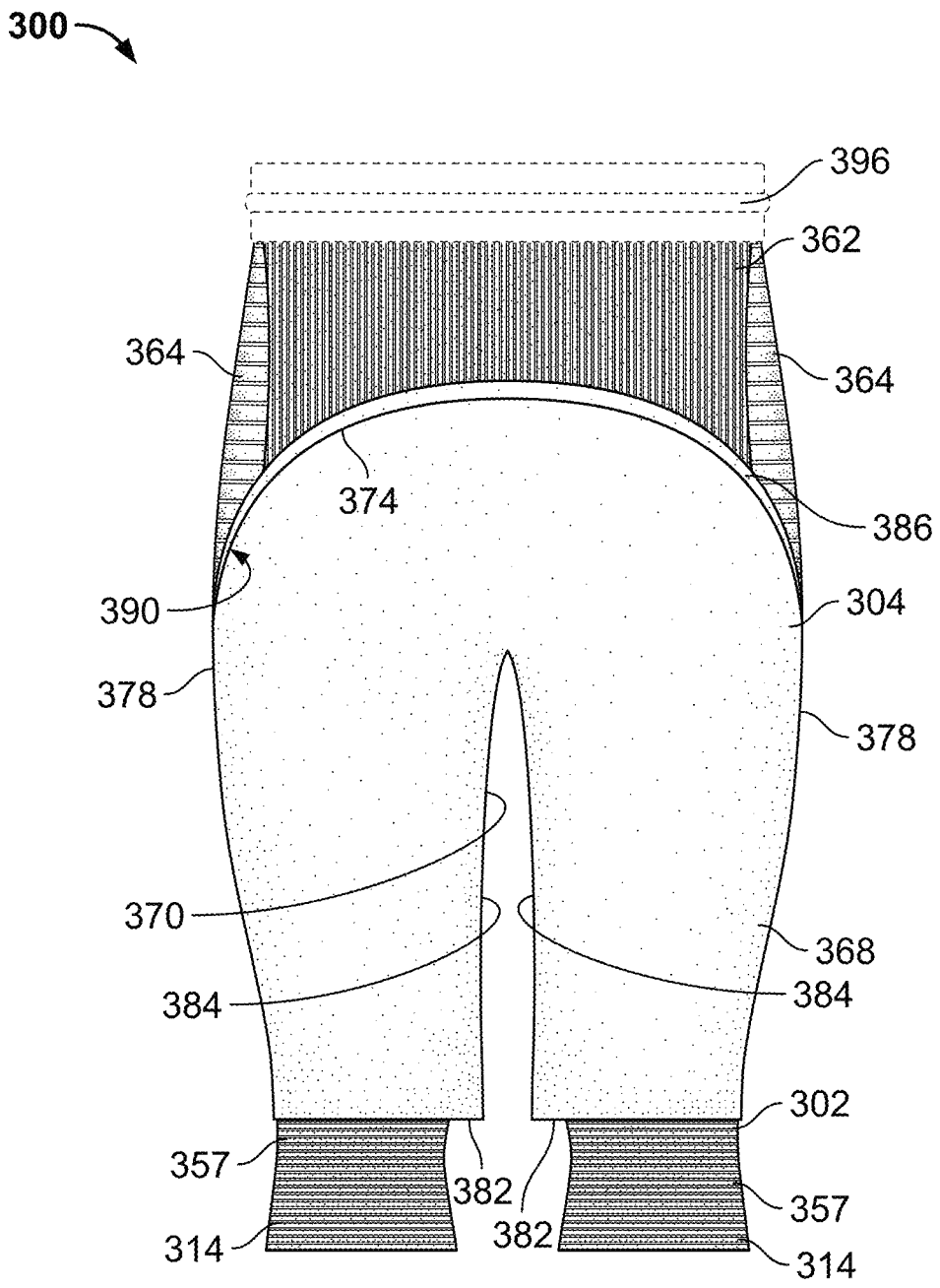
FIG. 20 is a rear view of the garment of FIG. 19.
Figure 21:
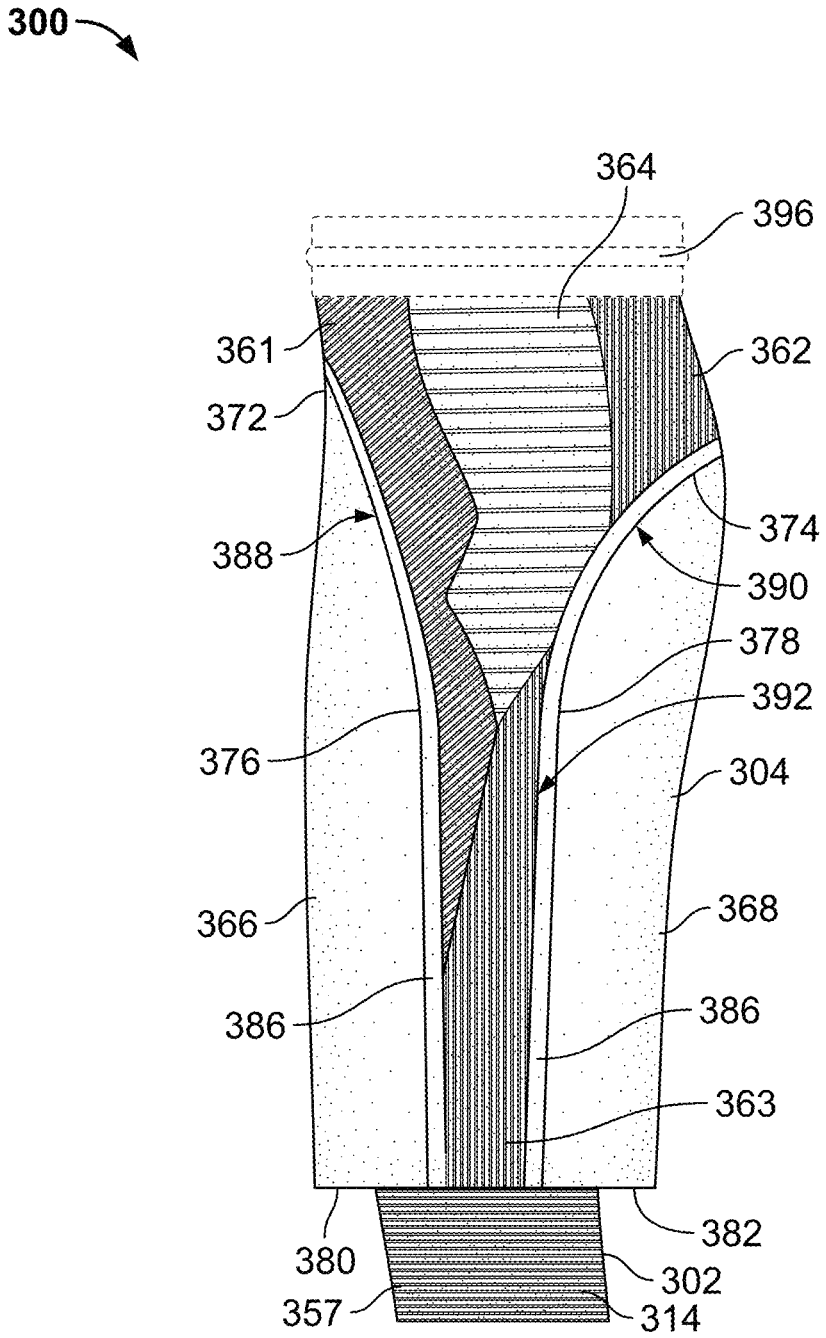
FIG. 21 is a side view of the garment of FIG. 19.
Figure 22:
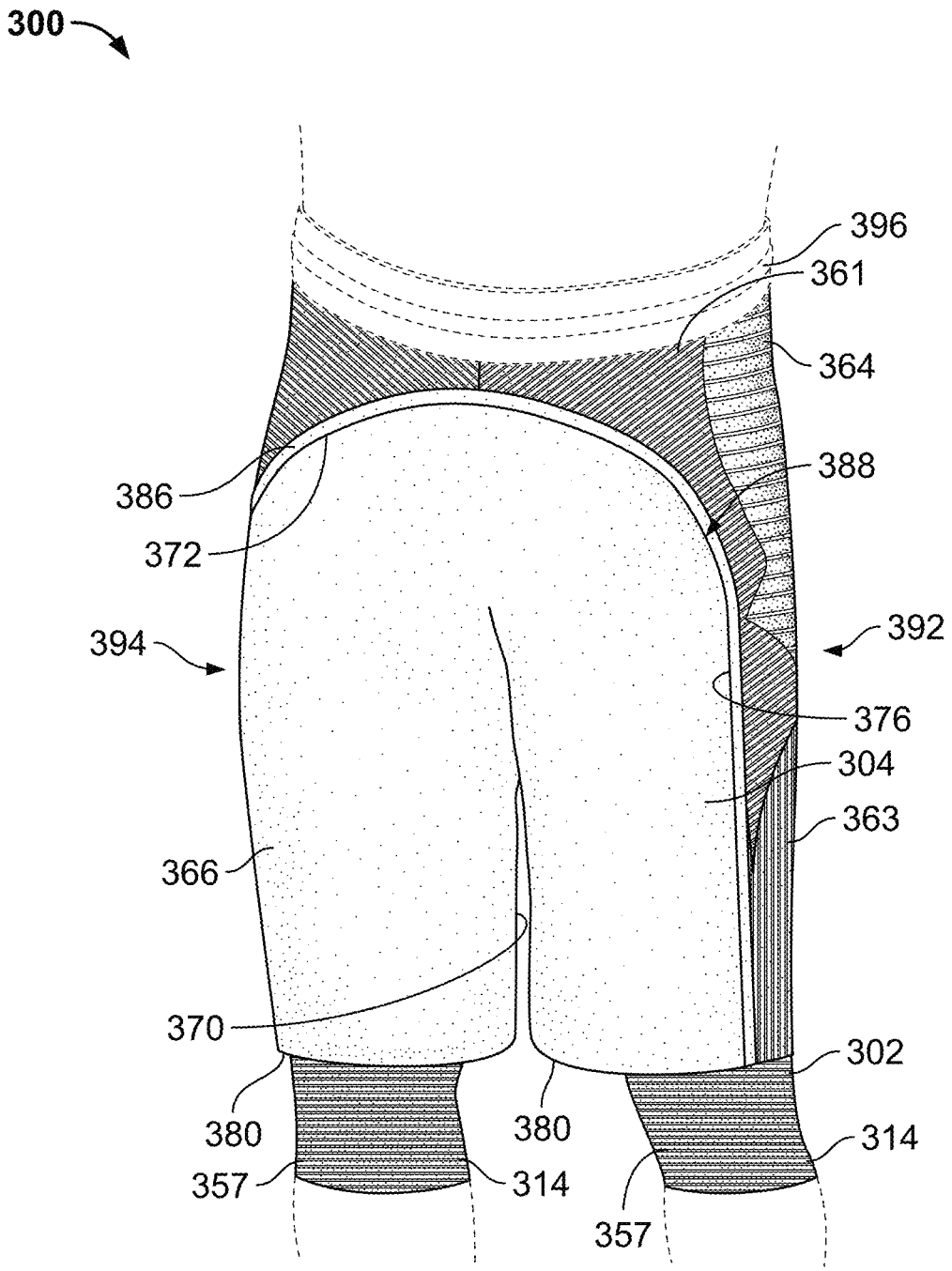
FIG. 22 is a front, isometric view of the garment of FIG. 19, displayed on the body of a person.
Figure 23:
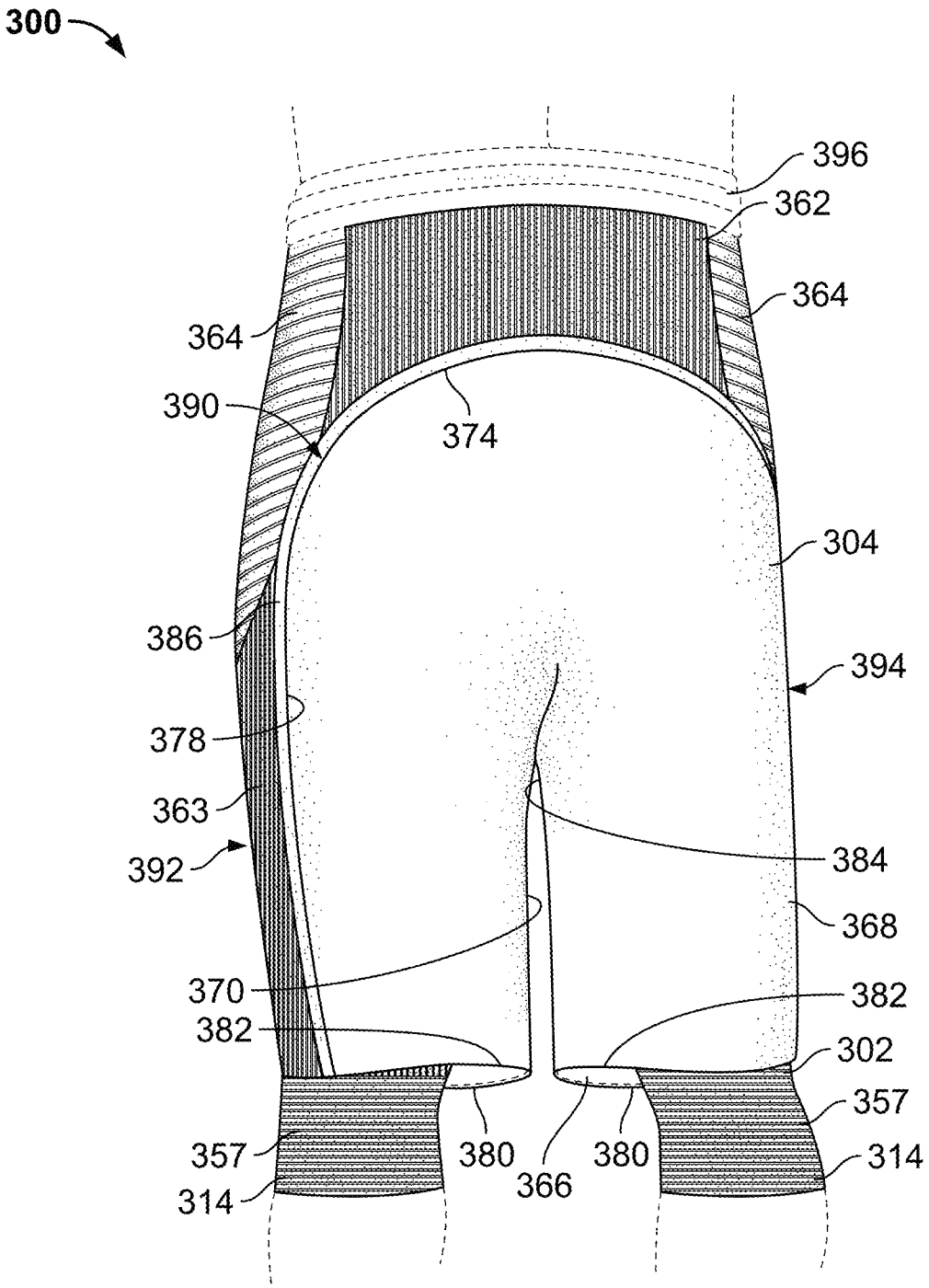
FIG. 23 is a rear, isometric view of the garment of FIG. 19, displayed on the body of a person.
Figure 24:
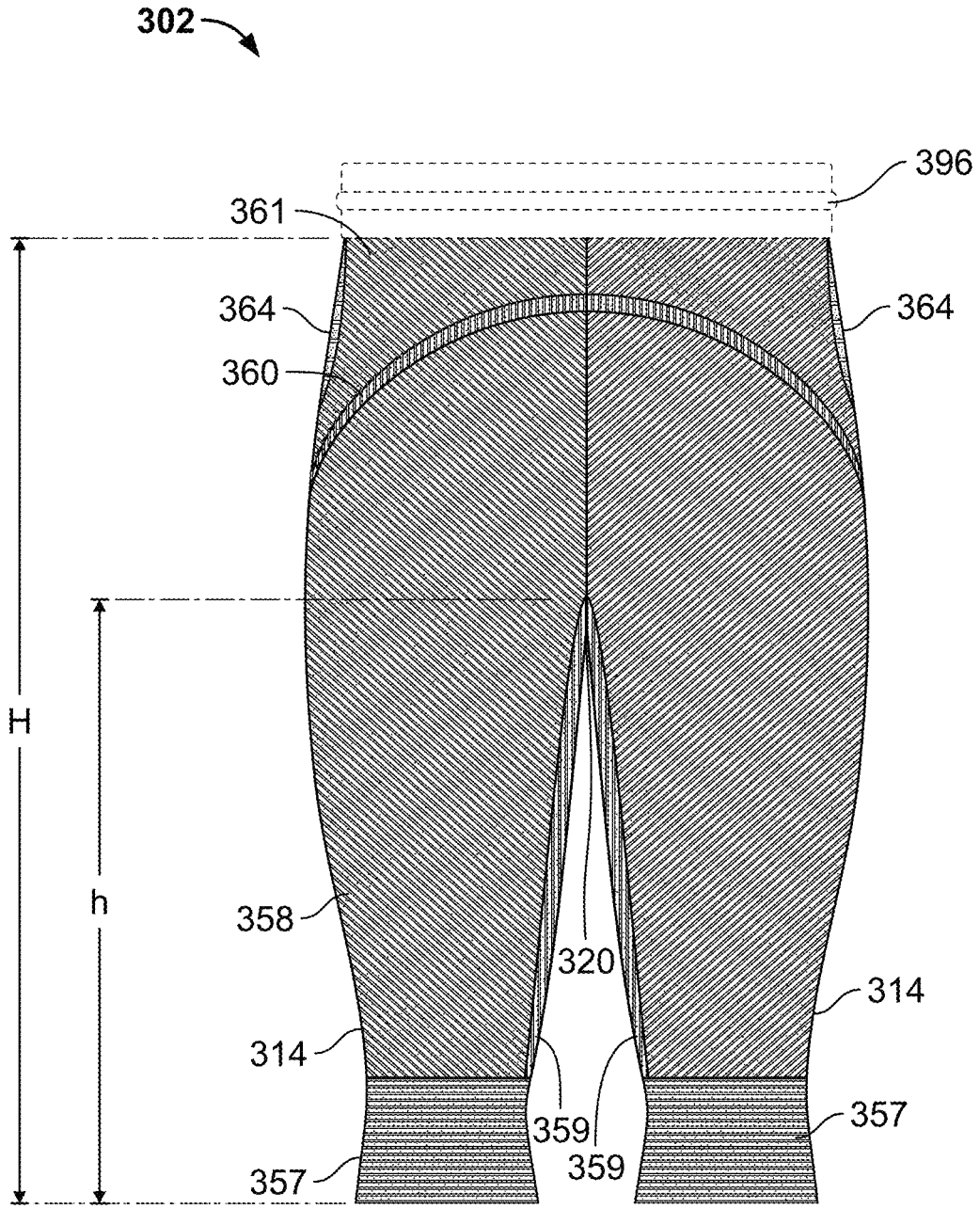
FIG. 24 is a front view of the base layer of the garment of FIG. 19.
Figure 25:
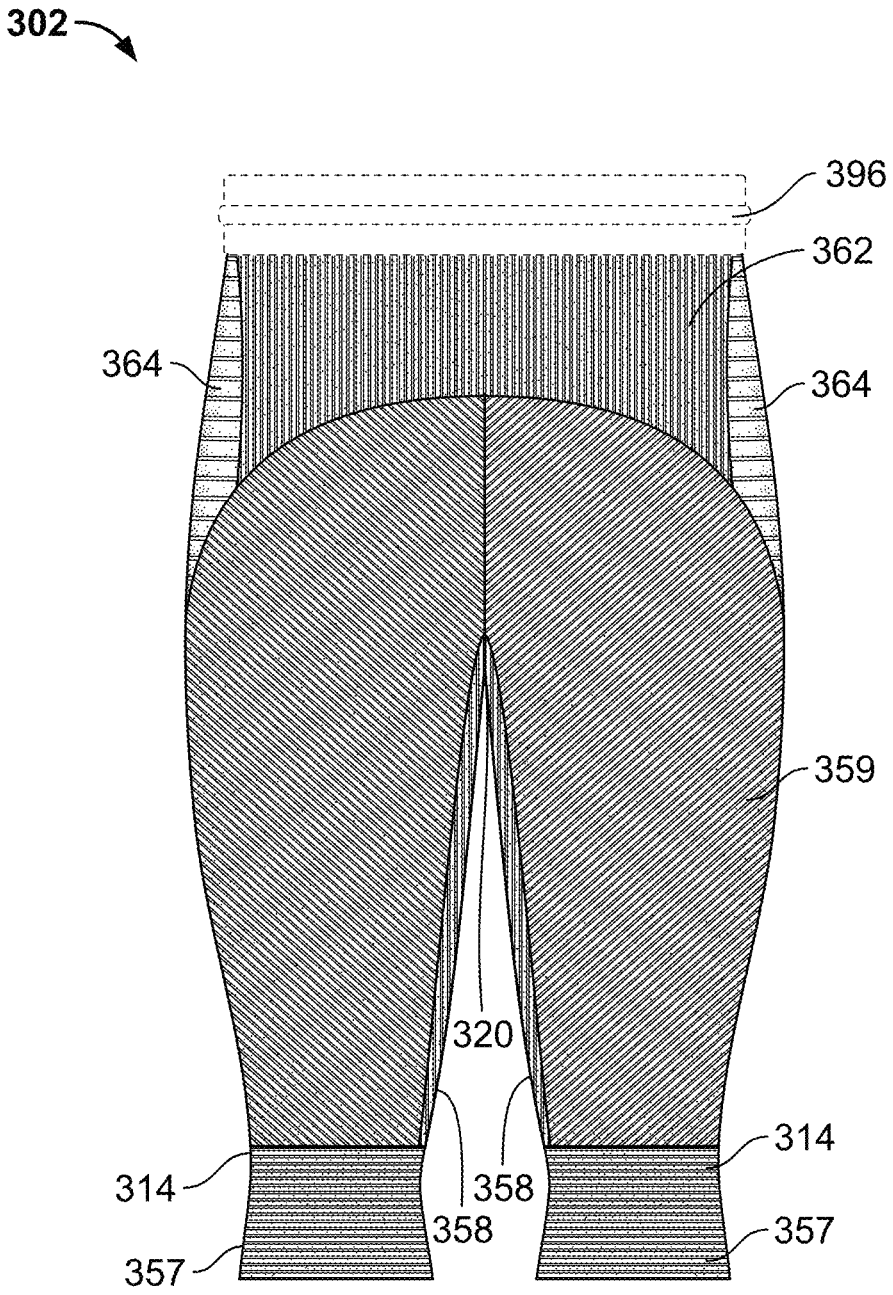
FIG. 25 is a rear view of the base layer of the garment of FIG. 19.
Figure 26:
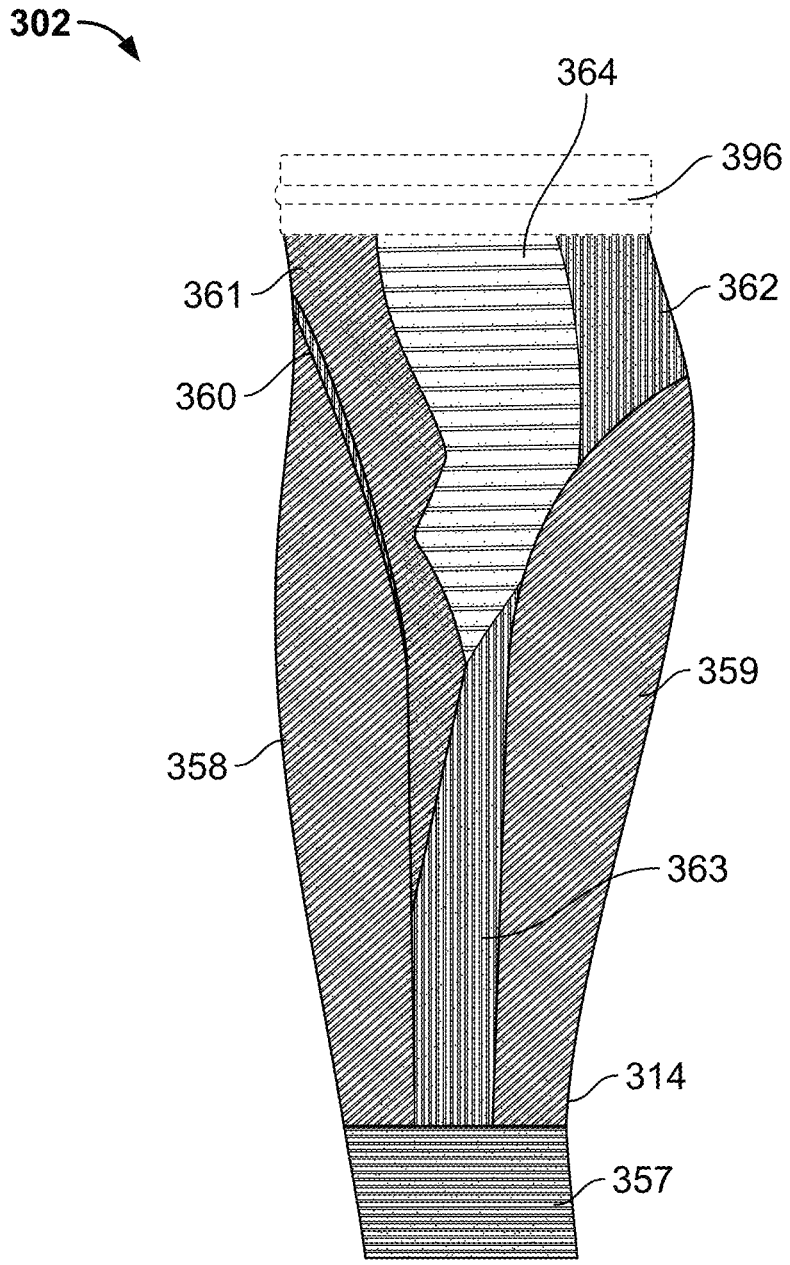
FIG. 26 is a side view of the base layer of the garment of FIG. 19.
Figure 27:
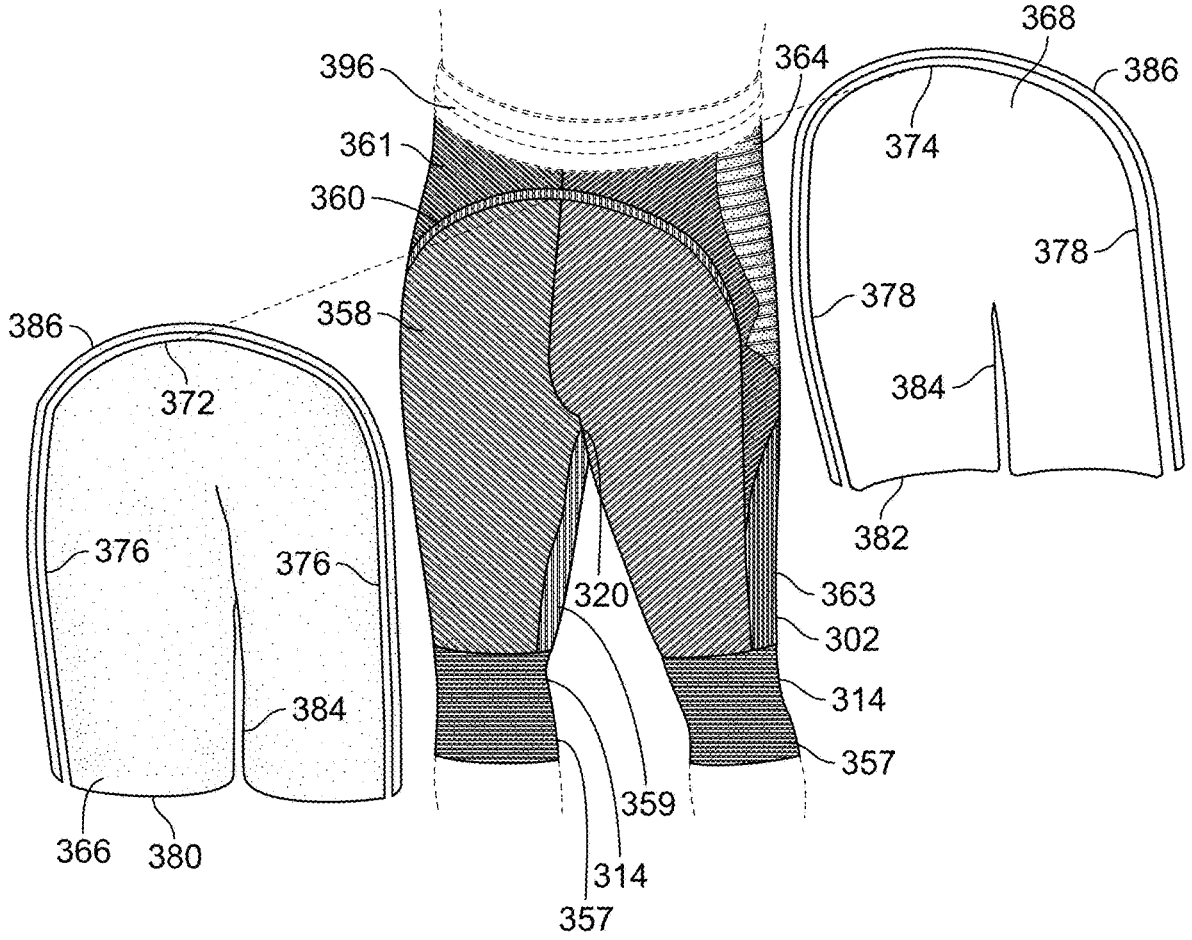
FIG. 27 is an isometric, exploded view of the garment of FIG. 19.
Figure 28:
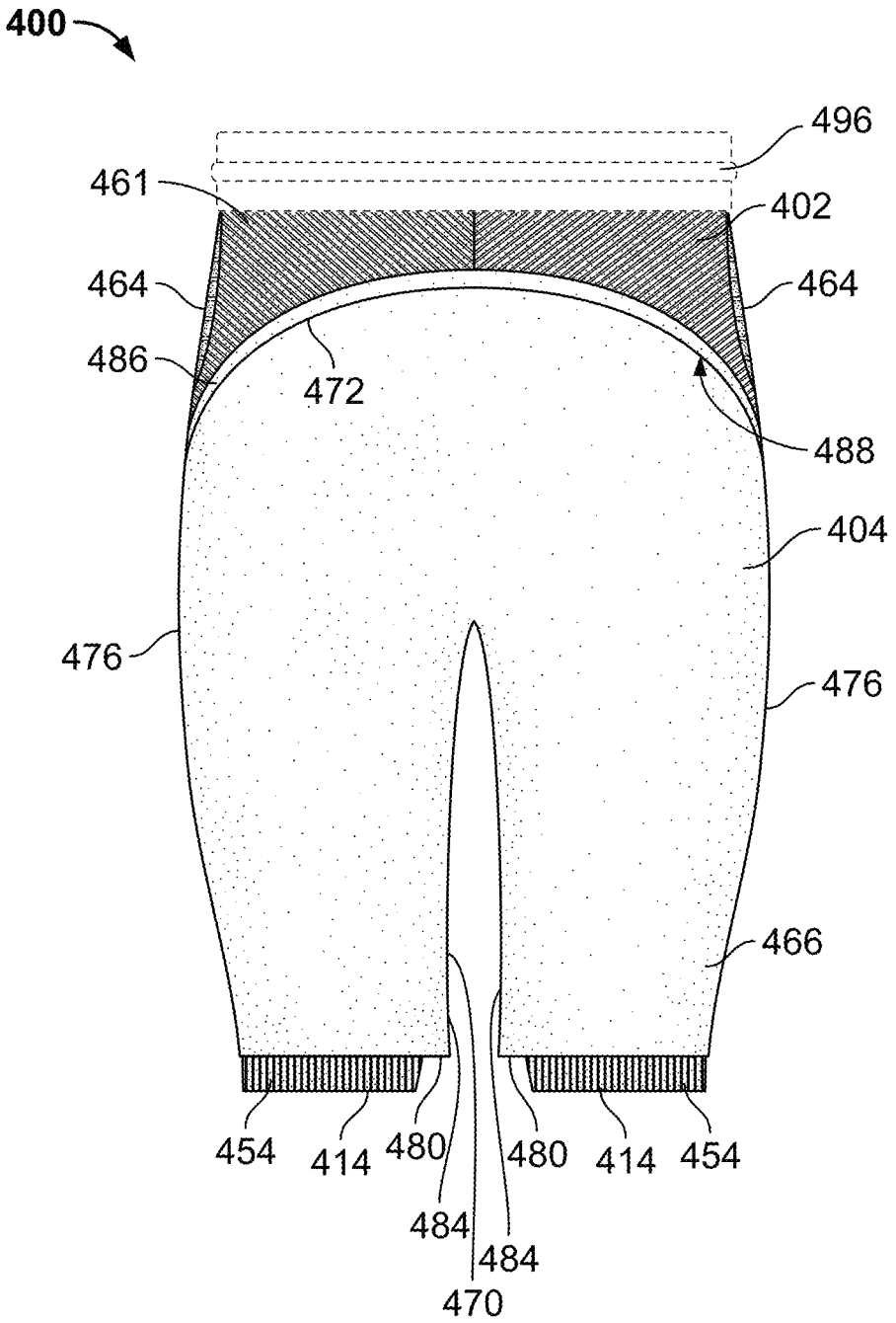
FIG. 28 is a front view of a fourth garment including a base layer and an outer layer covering at least a portion of the base layer.
Figure 29:
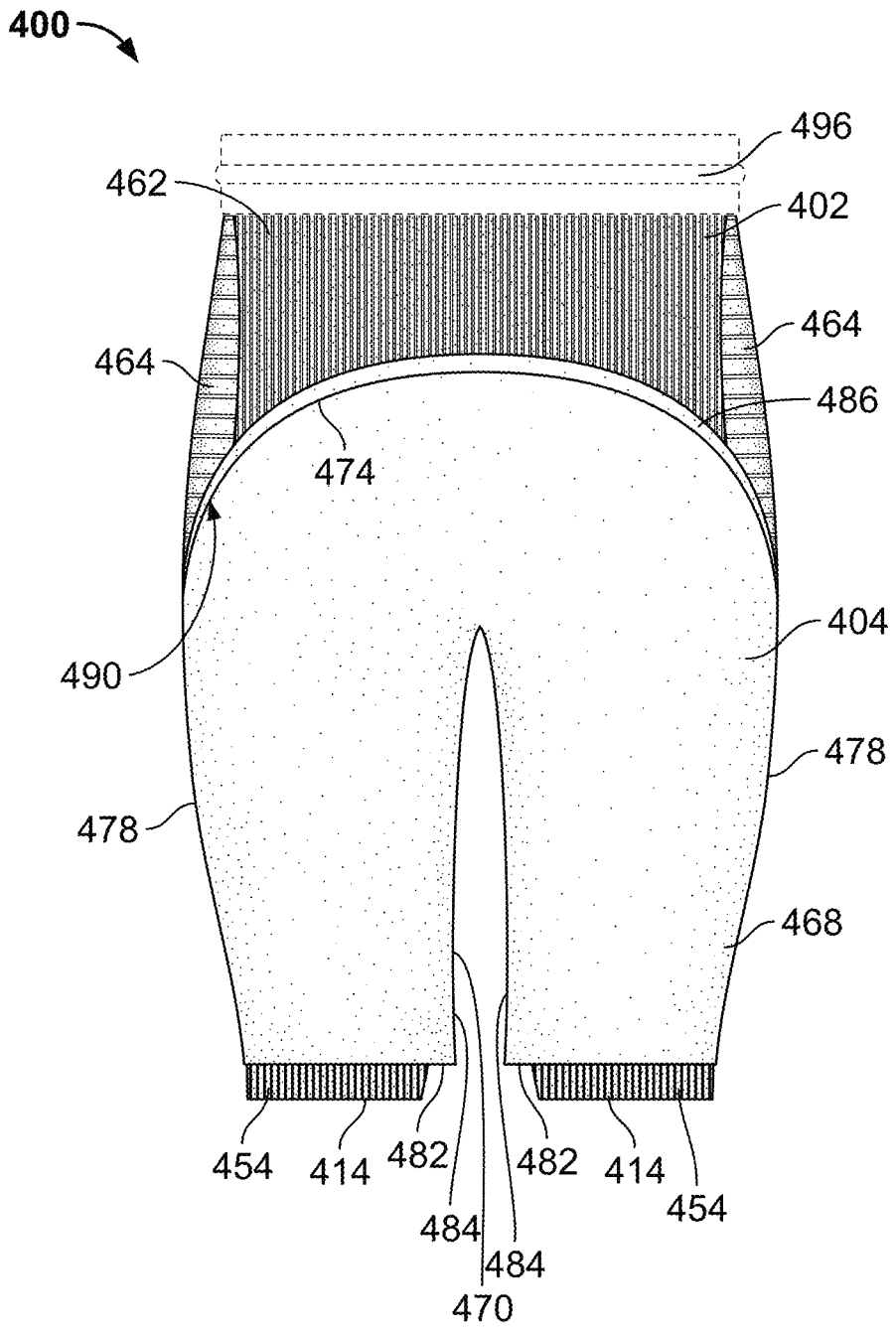
FIG. 29 is a rear view of the garment of FIG. 28.
Figure 30:
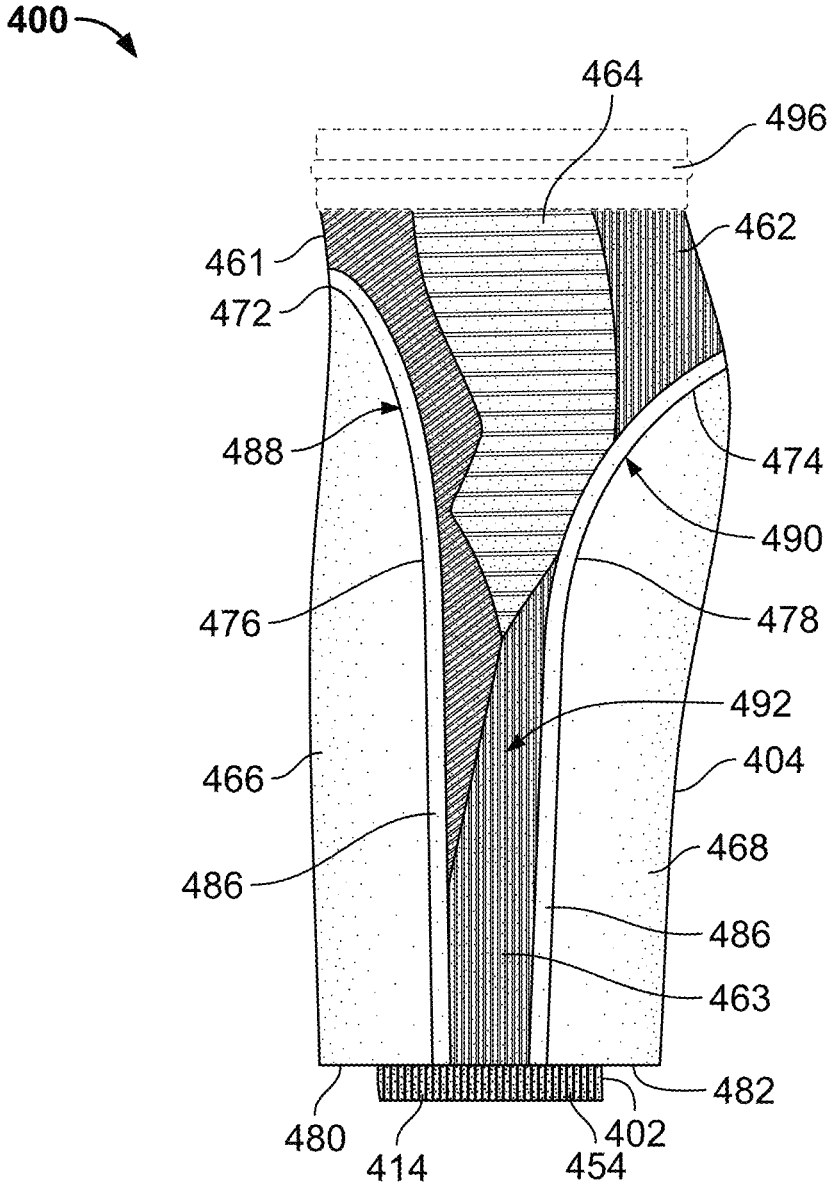
FIG. 30 is a side view of the garment of FIG. 28.
Figure 31:
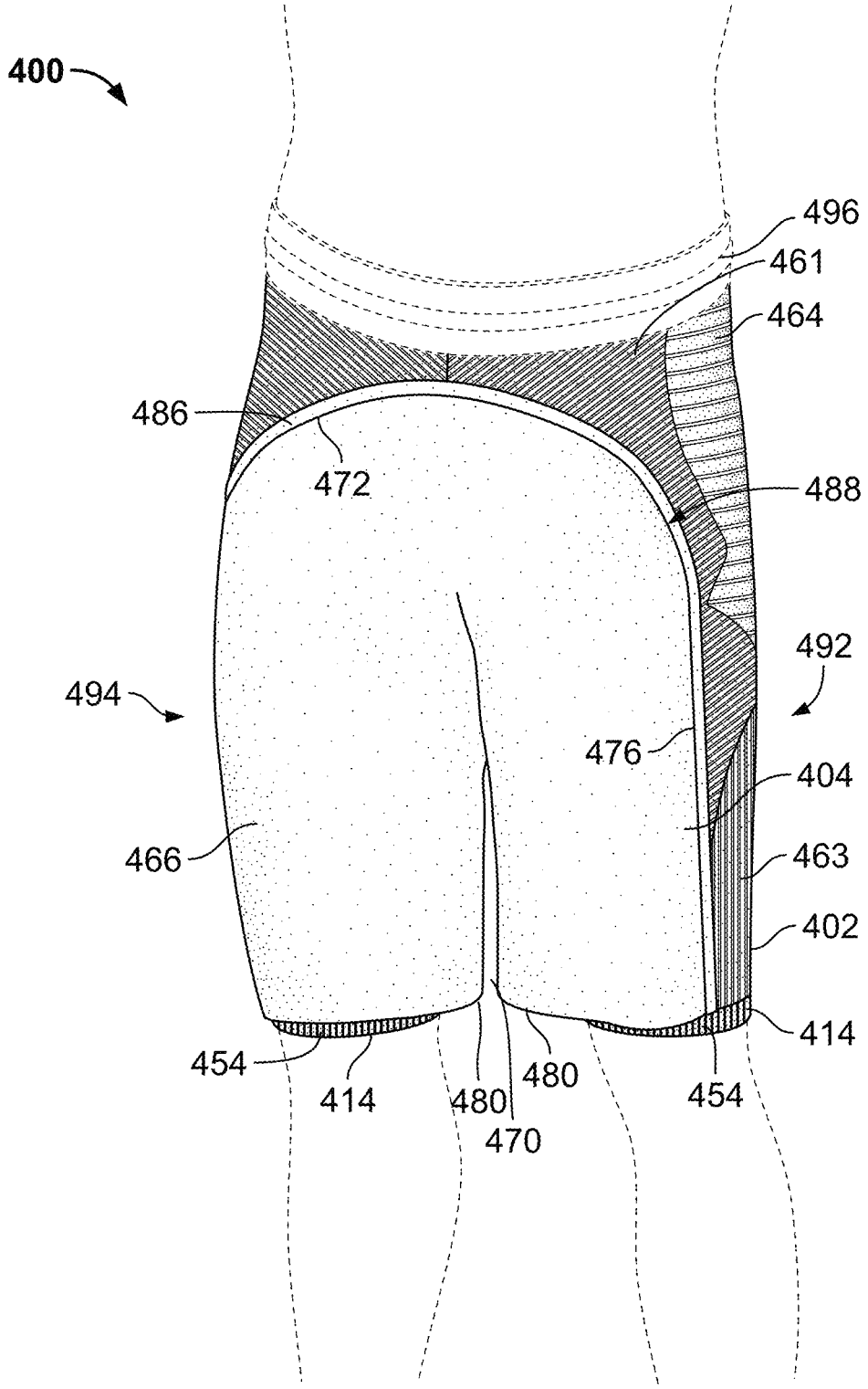
FIG. 31 is a front, isometric view of the garment of FIG. 28, displayed on the body of a person.
Figure 32:
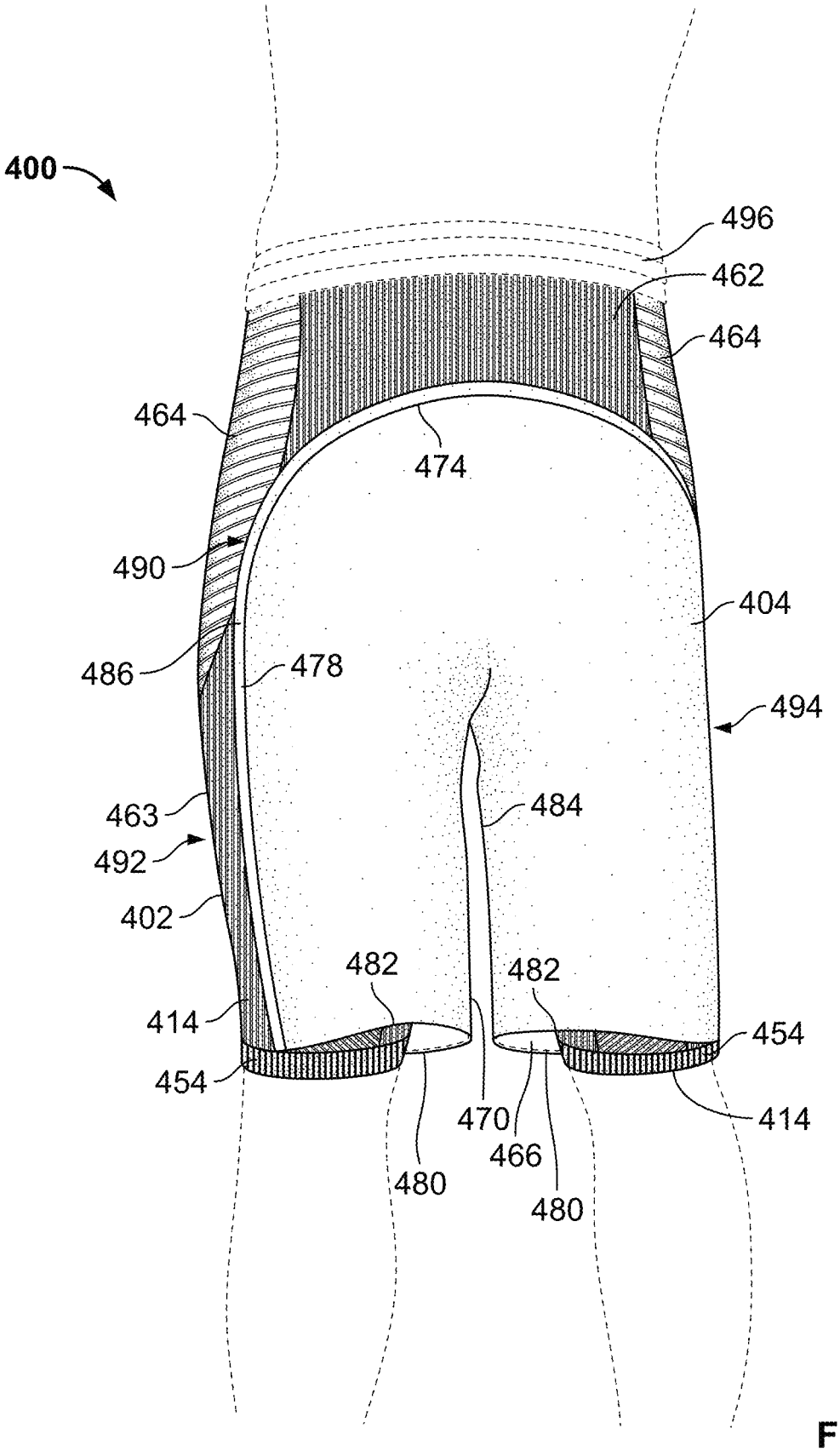
FIG. 32 is a rear, isometric view of the garment of FIG. 28, displayed on the body of a person.
Figure 33:
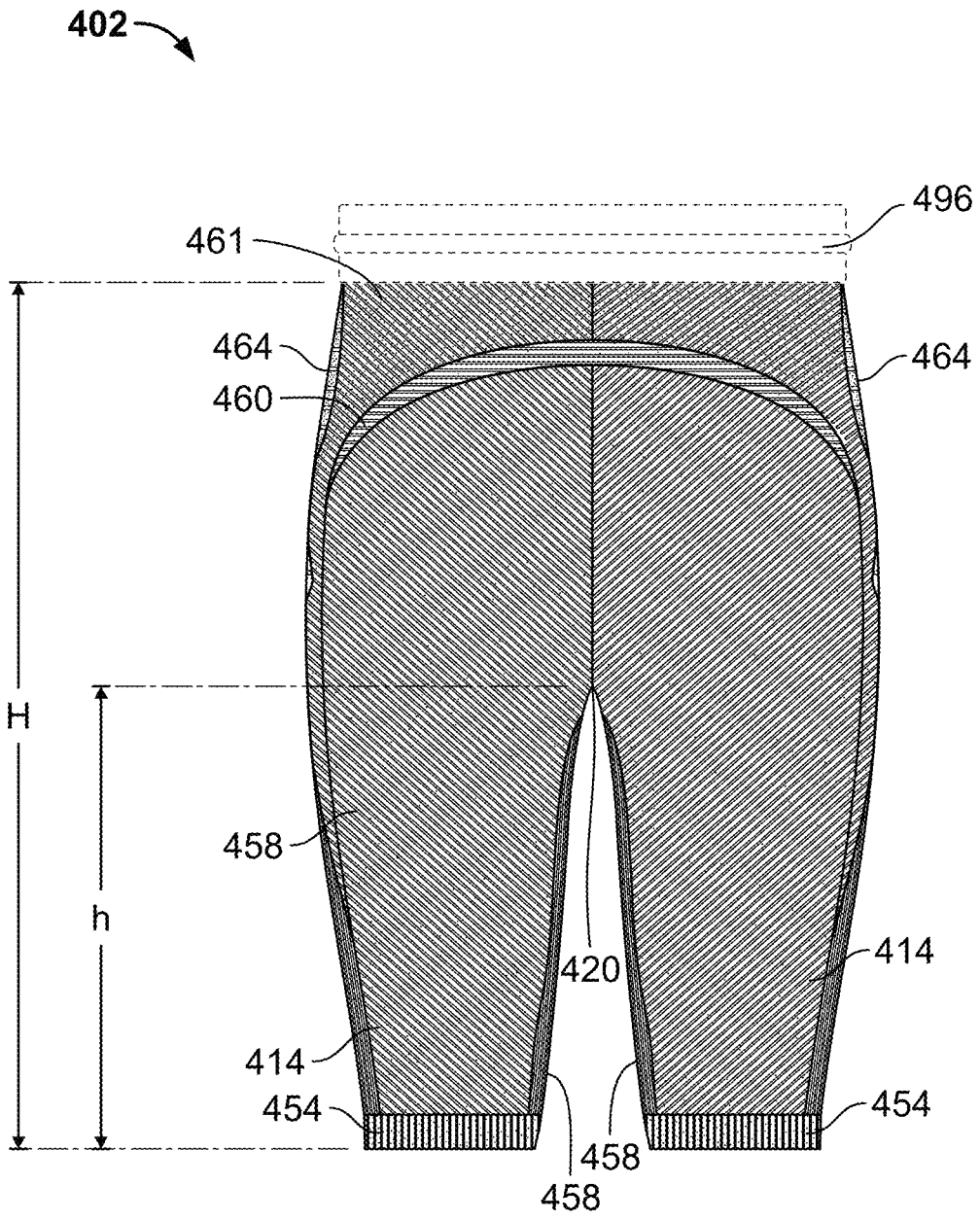
FIG. 33 is a front view of the base layer of the garment of FIG. 28.
Figure 34:
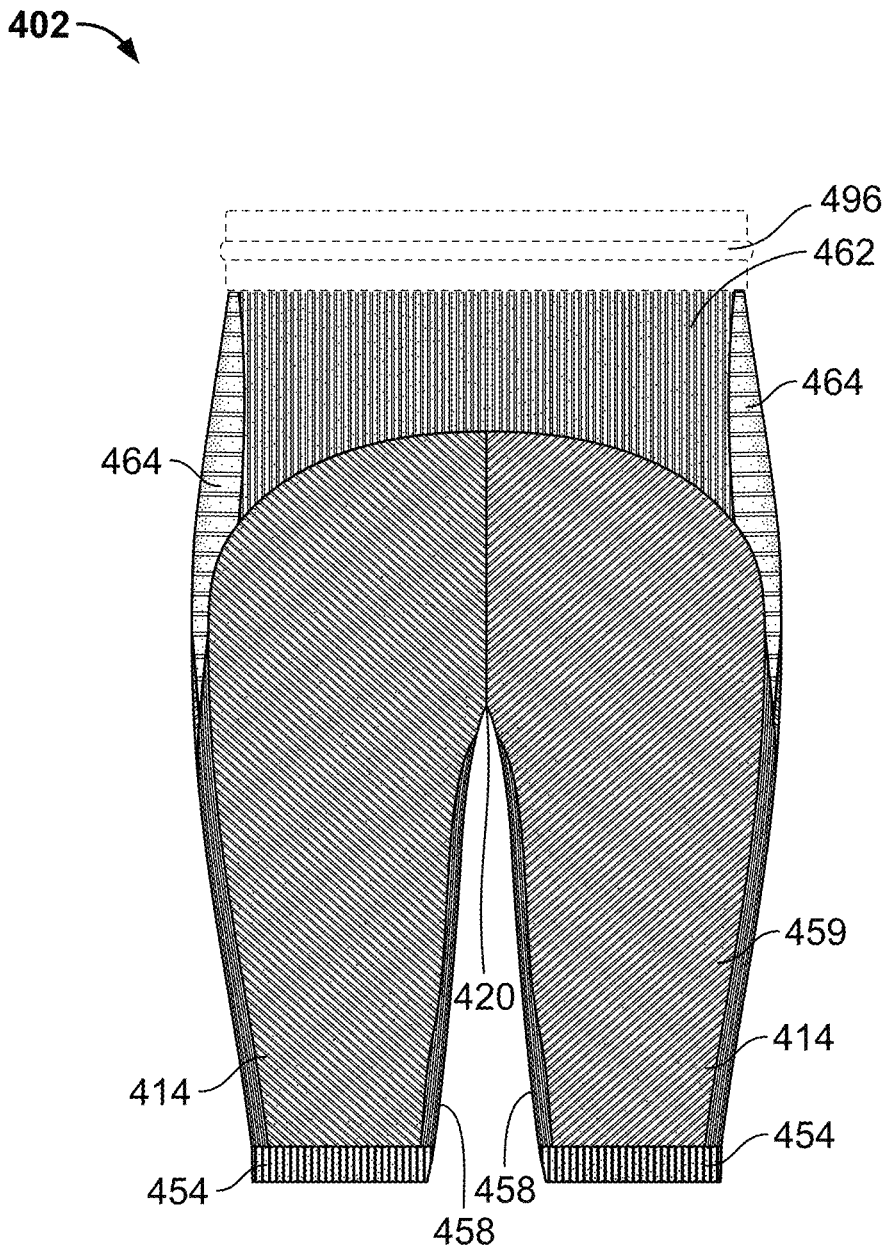
FIG. 34 is a rear view of the base layer of the garment of FIG. 28.
Figure 35:
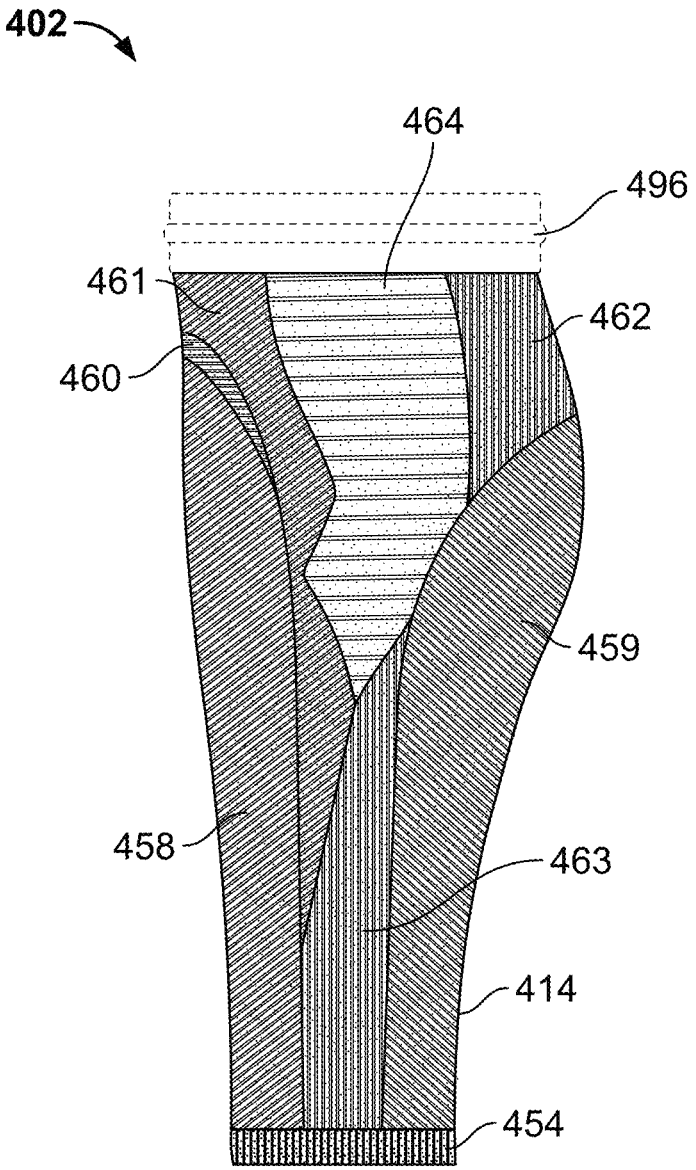
FIG. 35 is a side view of the base layer of the garment of FIG. 28.
Figure 36:
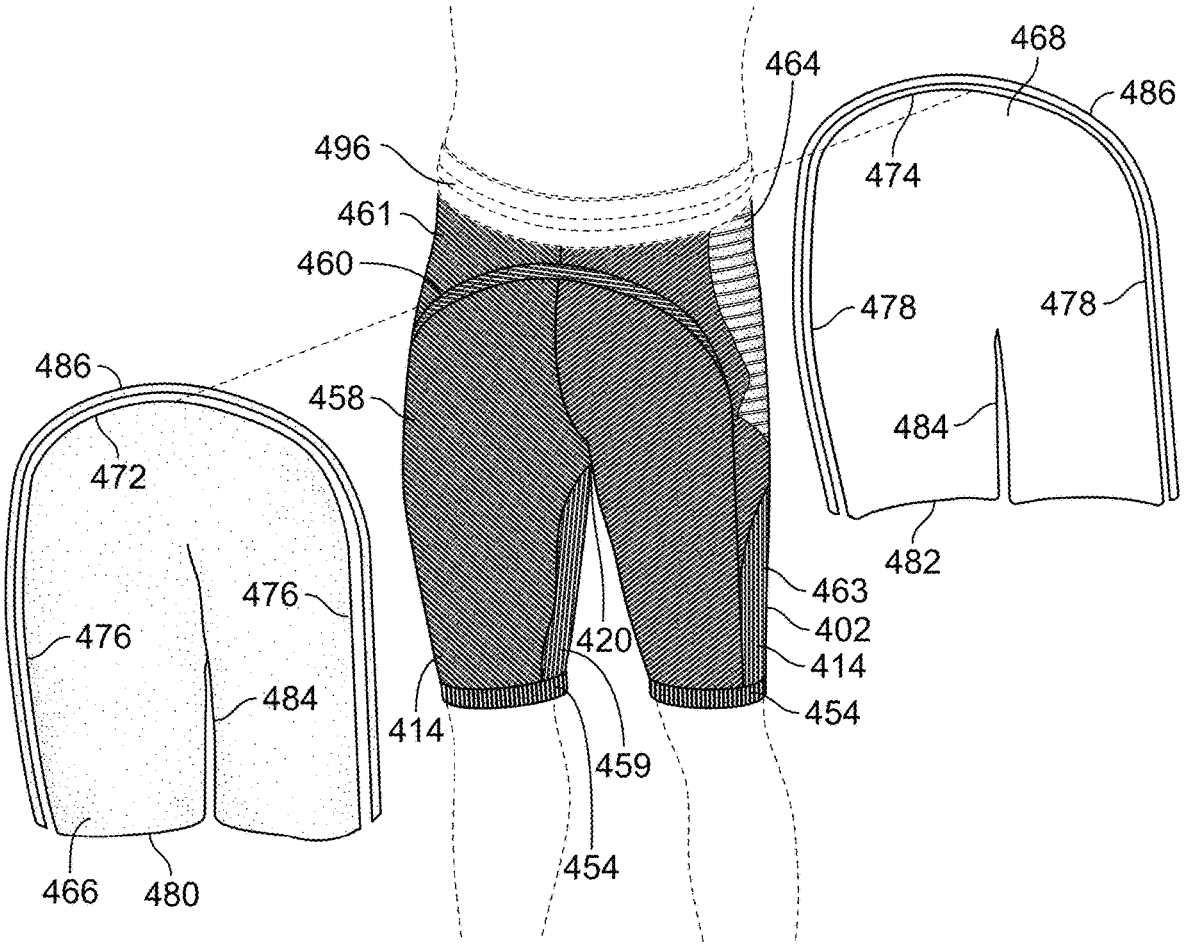
FIG. 36 is an isometric, exploded view of the garment of FIG. 28.
Figure 37:
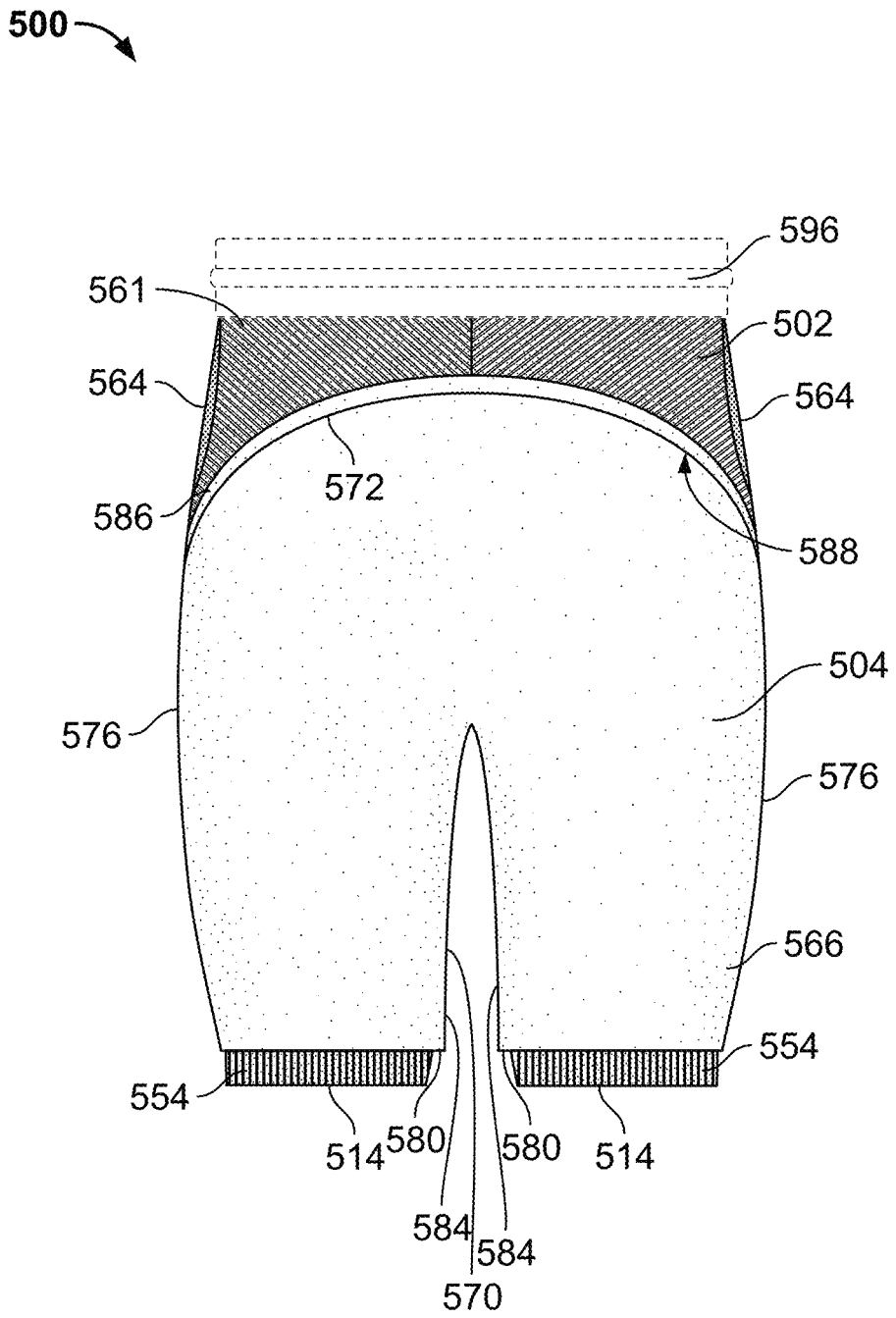
FIG. 37 is a front view of a fifth garment including a base layer and an outer layer covering at least a portion of the base layer.
Figure 38:
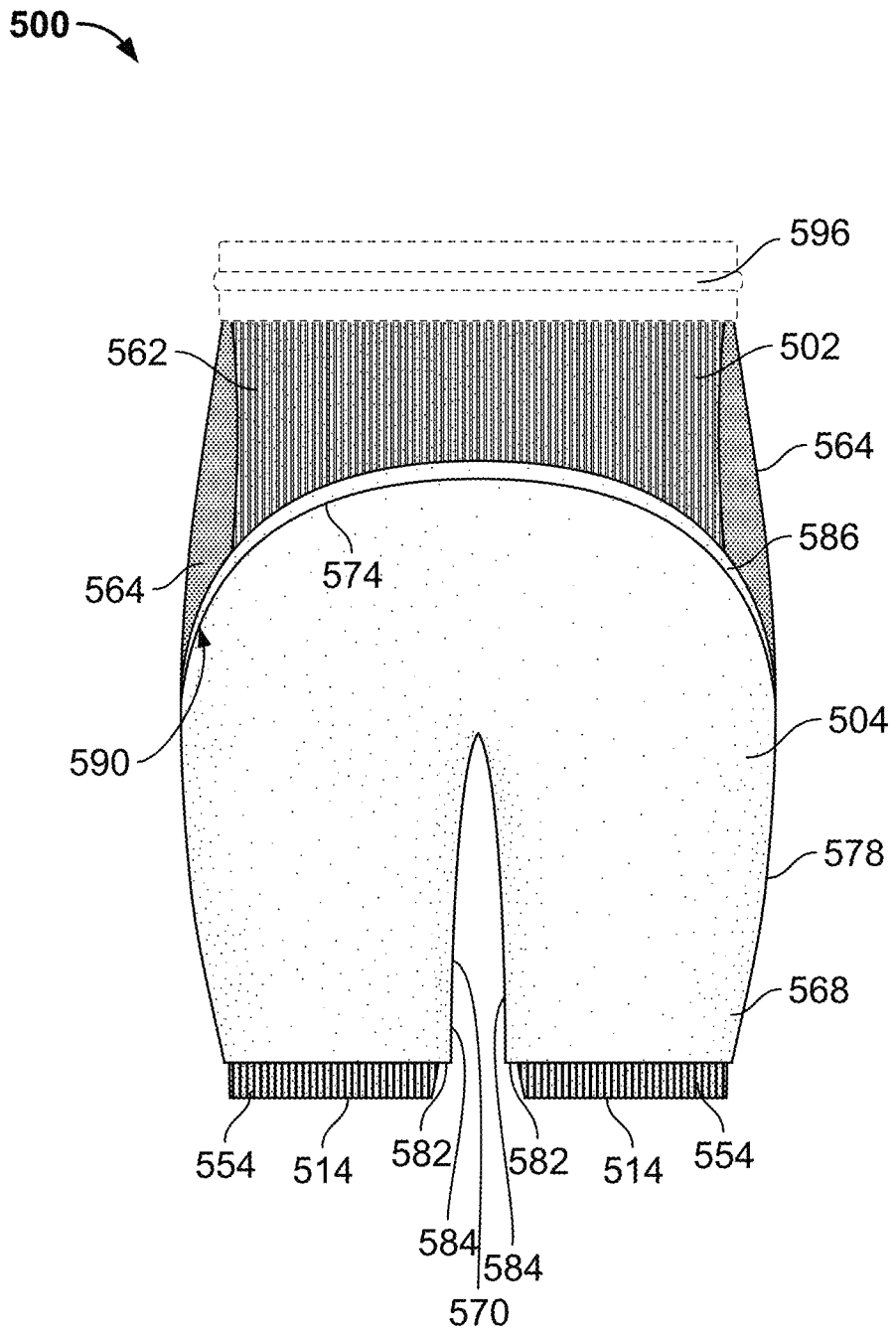
FIG. 38 is a rear view of the garment of FIG. 37.
Figure 39:
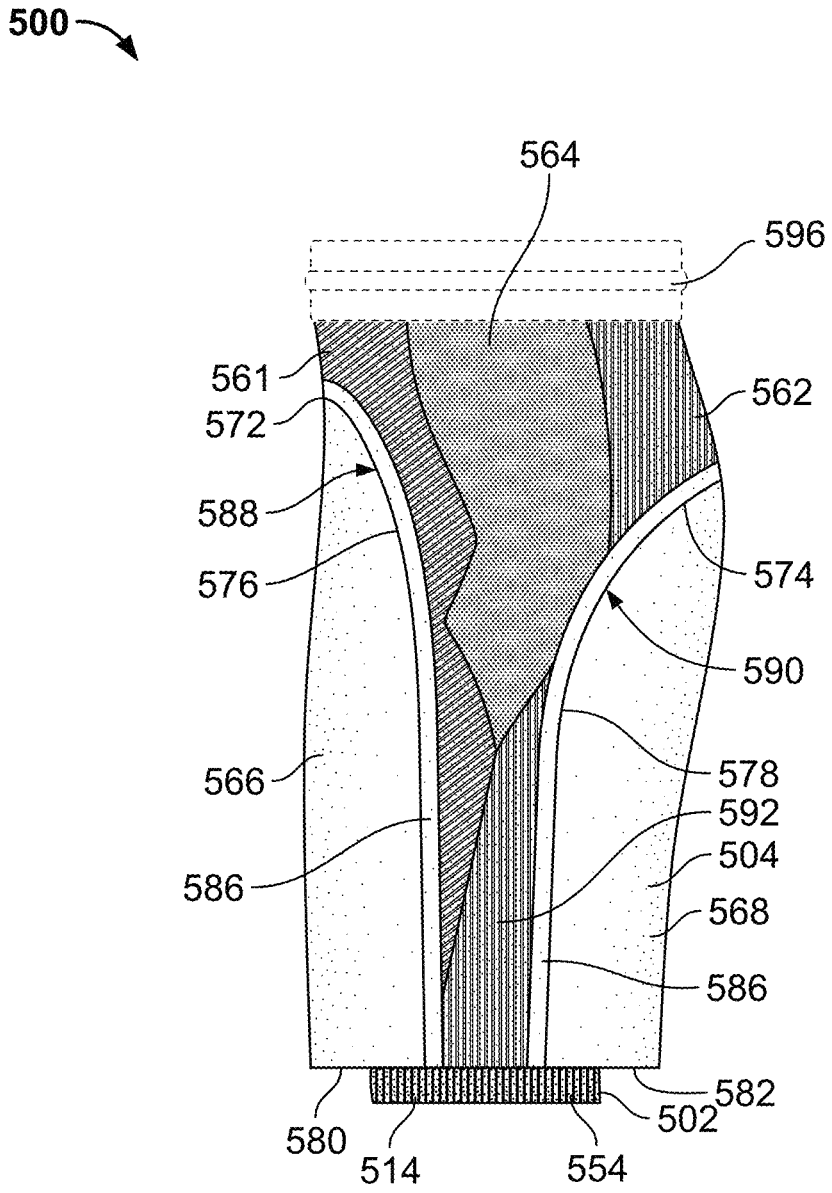
FIG. 39 is a side view of the garment of FIG. 37.
Figure 40:
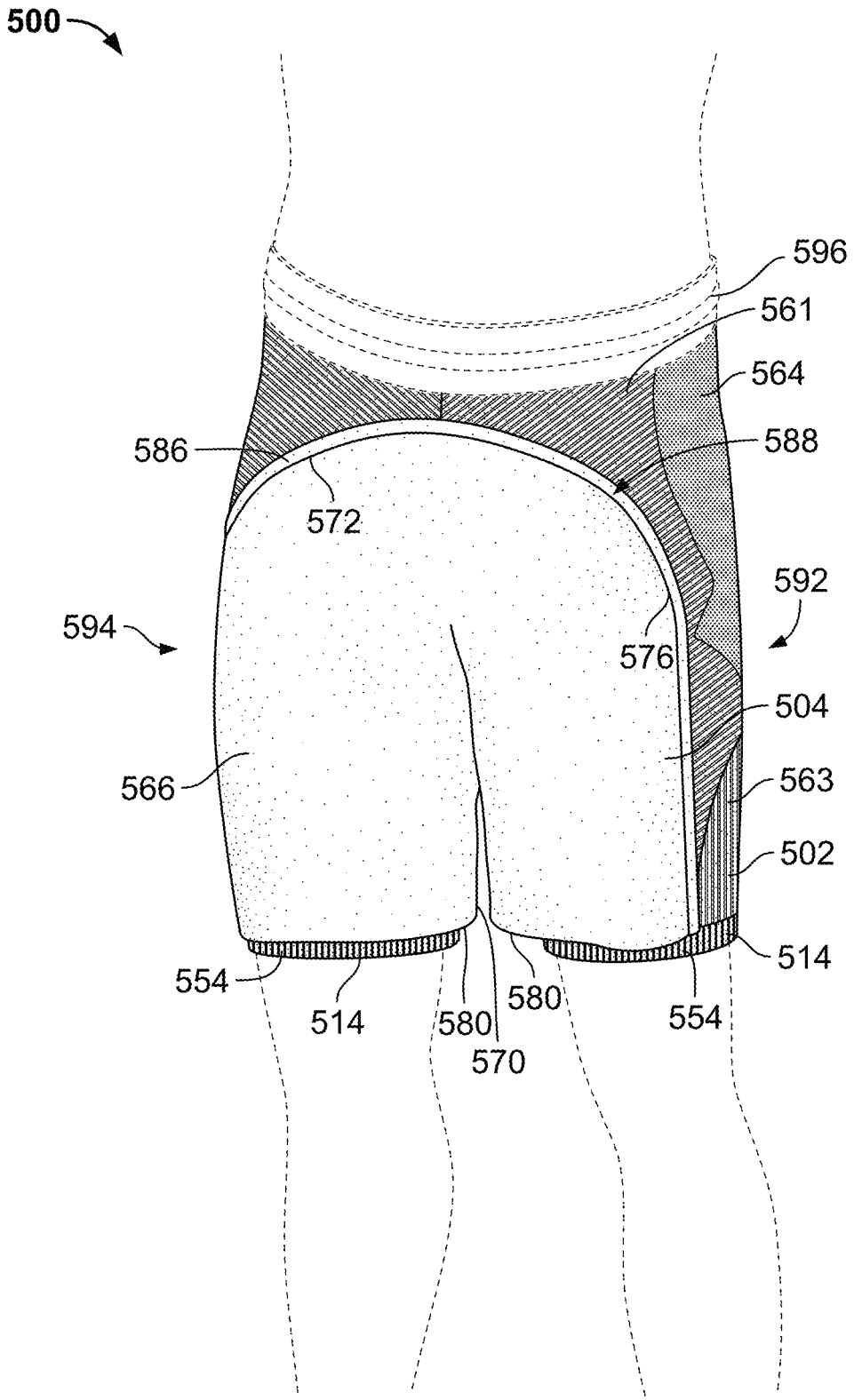
FIG. 40 is a front, isometric view of the garment of FIG. 37, displayed on the body of a person.
Figure 41:
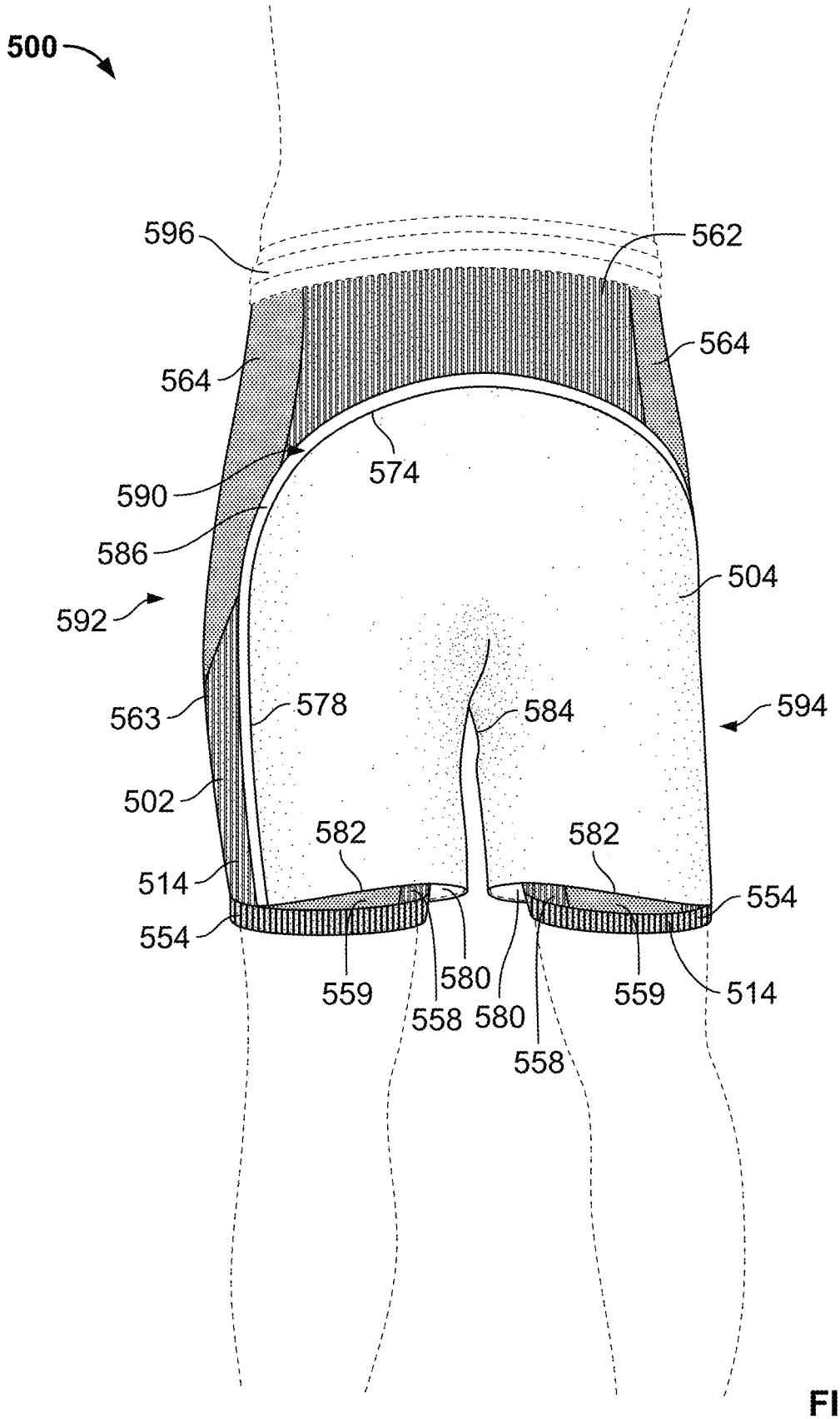
FIG. 41 is a rear, isometric view of the garment of FIG. 37, displayed on the body of a person.
Figure 42:
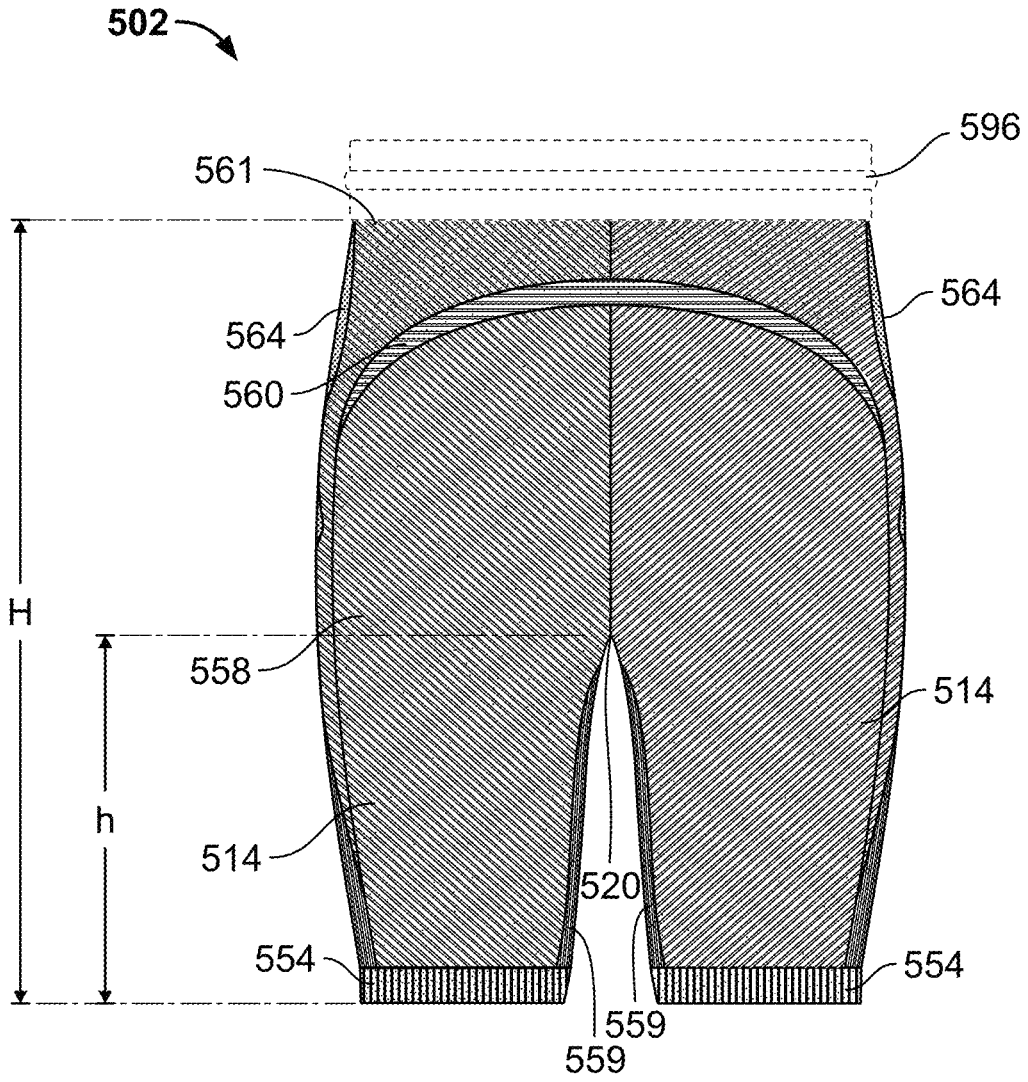
FIG. 42 is a front view of the base layer of the garment of FIG. 37.
Figure 43:
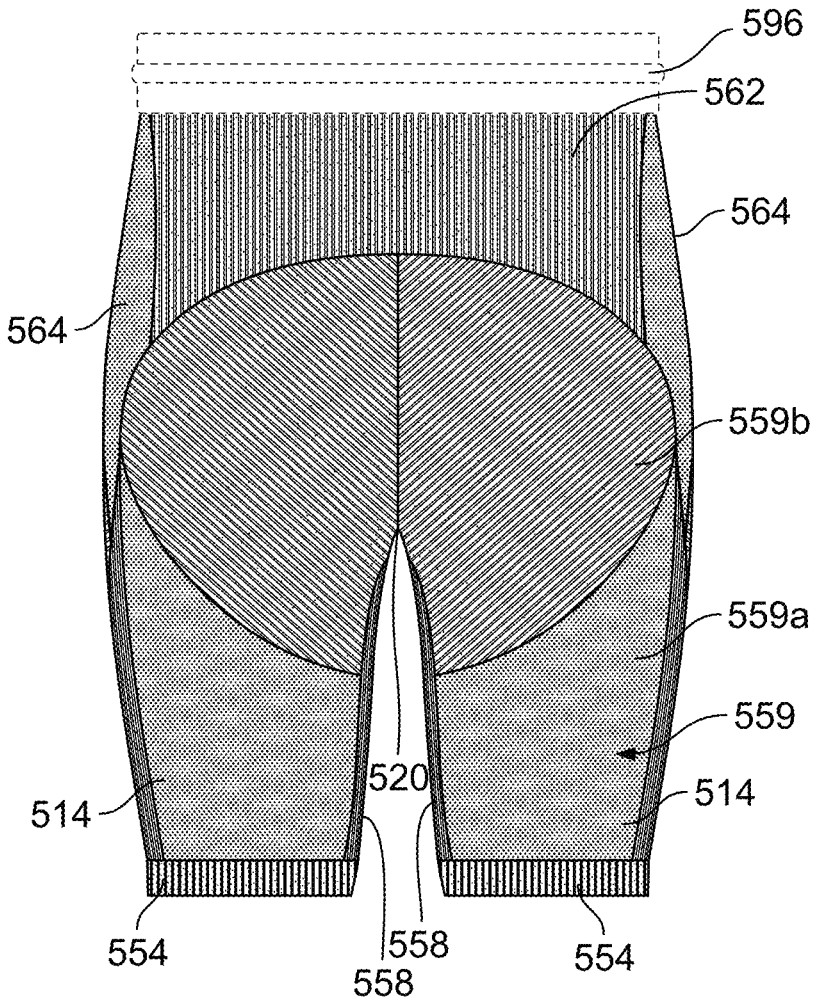
FIG. 43 is a rear view of the base layer of the garment of FIG. 37.
Figure 44:
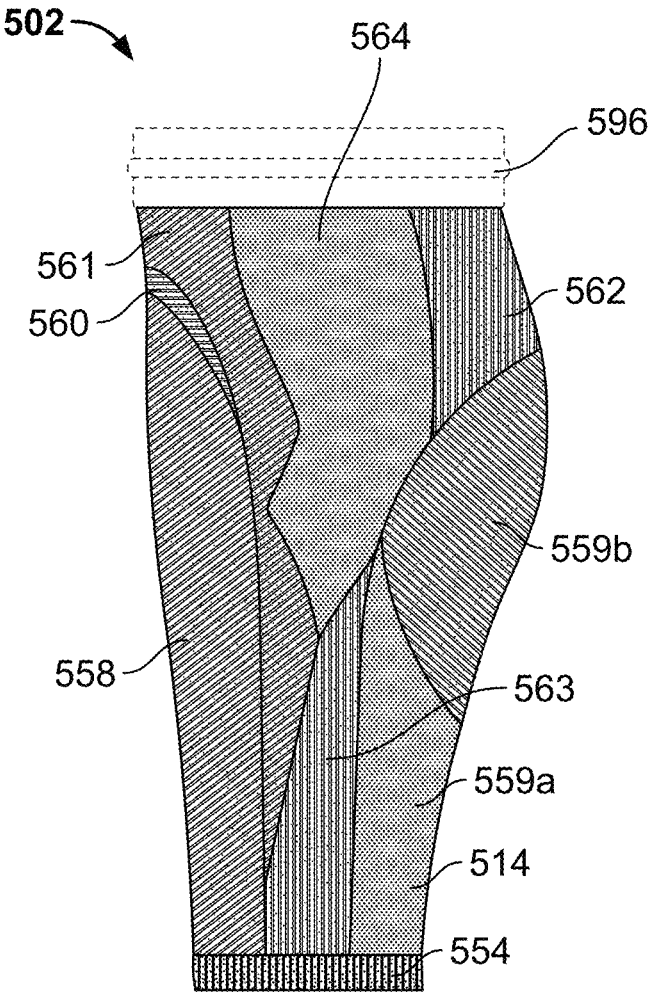
FIG. 44 is a side view of the base layer of the garment of FIG. 37.
Figure 45:
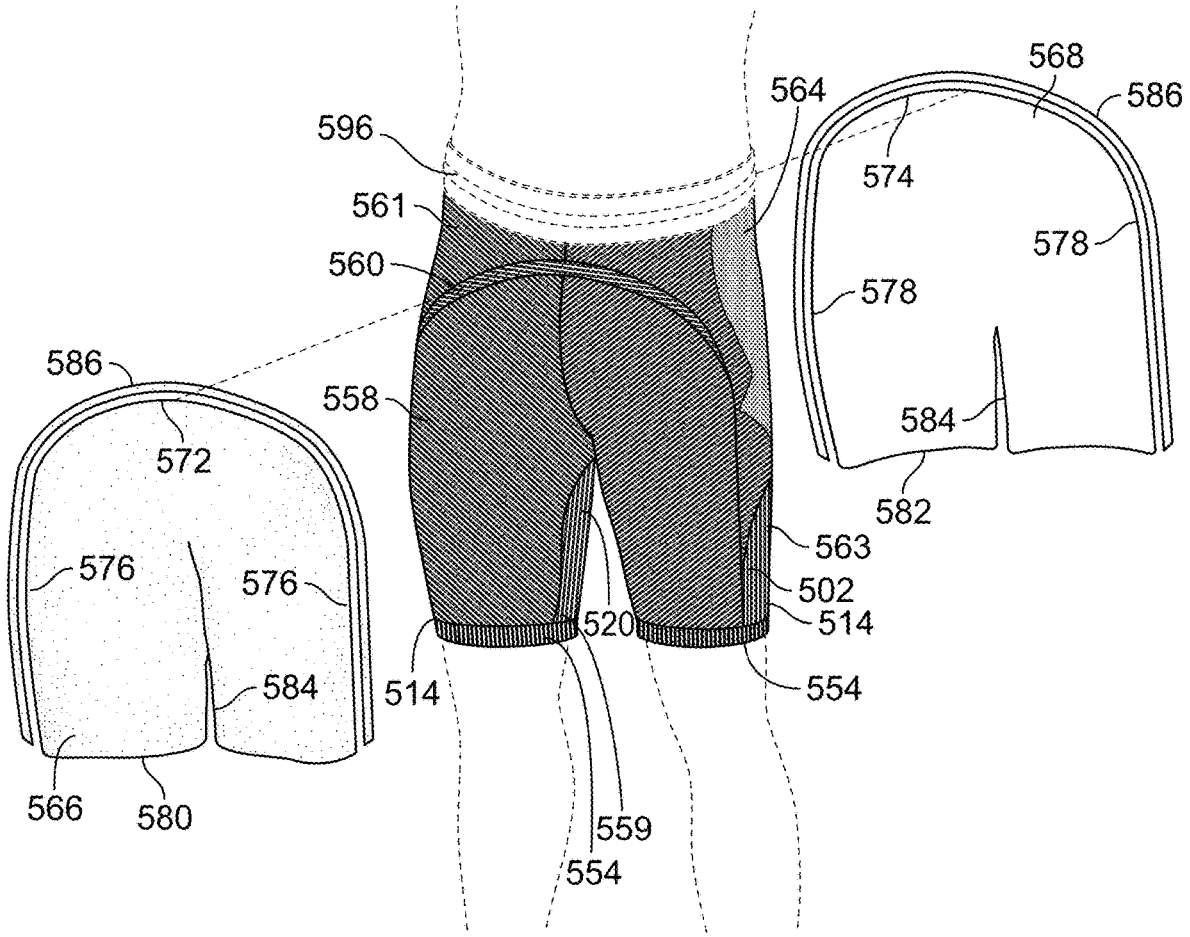
FIG. 45 is an isometric, exploded view of the garment of FIG. 37.

As seen in FIGS. 4, 5, and 9, in the aspect described above, the garment 100 may include a base layer 102 that covers a user's torso, the entirety of the user's arms, and the user's legs from the waist to a location slightly above the knee, as well as an outer layer 104 sized so that it will cover the wearer from just below the waist to slightly more above the knee than a lower end of the base layer 102. In other aspects, such as the examples that follow, the garment 100 may include varying amounts of coverage for one or both of the base layer 102 and outer layer 104. As can be seen in FIGS. 4, 5, and 9, the outer layer 104 may be shaped to have a periphery that has an upper end that defines a concave down shape.

In the following figures, it should be understood that similar reference numerals correspond to similar features described above, albeit with different leading prefixes. For example, in the examples of FIGS. 10-18, the garment is represented with reference numeral 200 instead of 100, its base layer is 202 instead of 102, its outer layer is 204 instead of 104, etc. As such, one of ordinary skill in the art should appreciate that a reference numeral used in the figures may not appear in the specification but that its meaning can be discerned from the portions of the specification above that describe the first embodiment.

Turning now to FIGS. 10-18, another garment 200 is depicted. In this aspect, the garment 200 may include a base layer 202 in the form of compression pants, i.e., extending from the waist area to proximate a wearer's ankles. Again, the base layer 202 may be made as a unitary knitted design (i.e. the fabric is produced on a knitting machine as a unitary part substantially without seams, however other methods may be used). More specifically, the entire base layer 202 may be made as a seamless or substantially seamless textile article without seams around the whole circumference of the garment 200 and along at least 40% of the total vertical extension, denoted by "H", of the garment 200, wherein the seamless section of the garment 200 extends at least along a part of the vertical extension "h" of the base layer 202. Preferably, the garment 200 is made as a seamless textile article around the whole circumference thereof and along at least 50% of the total vertical extension, or along at least 60% of the total vertical extension, or along at least 70% of the total vertical extension, or along at least 80% of the total vertical extension.

As mentioned above, the base layer 202 may provide compressive characteristics, such as sports grade compression. For example, the base layer 202 may provide soft compression, which may include 10 mmHg of compression near a wearer's ankles and 5 mmHg of compression near the wearer's waist area. As a further example, the base layer 202 may provide medium compression, which may include 20 mmHg of compression near the wearer's ankles and 8 mmHg of compression near the wearer's waist area. As still a further example, the base layer 202 may provide hard compression, which may include 25 mmHg of compression near the wearer's ankles and 10 mmHg near the wearer's waist area. The aforementioned compression combinations are non-limiting examples, and it is to be understood that aspects of the present disclosure may provide any appropriate configuration of compression, or no compression at all.

In particular, and with reference to FIGS. 15-18, the base layer 202 may include a pair of leg portions 214 with an inner leg seam 220 disposed at their juncture. The base layer may include a first region 254 of stretch resistance at a bottom of the base layer 202, i.e., proximate a wearer's ankles, a second region 255 of stretch resistance extending upward from the first region 254 along the wearer's shins, a third region 256 of stretch resistance extending upward from the first region 254 along the wearer's calves, a fourth region 257 of stretch resistance extending upward from the first and second regions, around the wearer's knee, a fifth region 258 of stretch resistance extending upward from the fourth region 257, above the knee and along the quadriceps, a sixth region 259 of stretch resistance extending upward from the fourth region 257, along the hamstrings and gluteal muscles, a seventh region 260 of stretch resistance extending upward from the fifth region 258 and defining a thin, concave down shape, an eighth region 261 of stretch resistance extending upward from the seventh region 260 to an upper end up the base layer, i.e., proximate a wearer's waist, a ninth region 262 of stretch resistance extending upward from the sixth region 259 to the upper end of the base layer, i.e., proximate a wearer's waist, and a tenth region 263 of stretch resistance, extending upward from the fourth region 257 along a lateral portion of the wearer's thigh. In addition, the base layer 202 may include one or more regions 264 of increased breathability, such as the regions extending downward from an upper end of the base layer 202, along the lateral portion of the wearer's thigh.

Returning to FIGS. 10-14 and 18, the outer layer 204 may be permanently attached or secured to the base layer 202. Similar to the previous example, the outer layer 204 may include a first piece 266 extending about a front side of the wearer's body and a second piece 268 extending about a rear side of the wearer's body, thereby giving the impression that the outer layer 204 is a pair of shorts. Again, it should be appreciated that one or both of the first piece 266 and the second piece 268 may comprise multiple pieces of material joined together in one fashion or another, e.g., as described above with regard to the garment 100 described above.

In one aspect, the first piece 266 and the second piece 268 each may be formed from a flat pattern, wherein the material forming the pattern may be knit, woven, or otherwise formed from other available materials using techniques that would be appreciated by one of ordinary skill in the relevant art. The first piece 266 and second piece 268 then may be connected together, e.g., by stitching or seam tape at a seam 270 that runs up an inseam of one of the leg portions and down the opposing inseam of the other leg portion.

Once formed and preferably but not necessarily after being connected to one another, the first piece 266 and second piece 268 may be joined to the base layer 202 around a portion of, and less than an entirety of, their peripheries. In particular, the first and second pieces may be joined to the base layer at their upper ends 272, 274, respectively, as well as along their lateral sides 276, 278, respectively. As a result, the first and second pieces 266, 268 may not be joined to the base layer 202 along their lower ends 280, 282, or their (joined) medial sides 284. In one aspect, seam tape 286 may be used to provide continuous attachment or bonding between each of the first and second pieces with the base layer 202 along their respective mating seams 288, 290. Additionally or alternatively, other methods of attachment such as stitching may be used along at least some of the seams 288, 290. For example, the first piece 266 and second piece 268 may be placed on the base layer 202 inside out, and then stitched thereto. After the first and second pieces 266, 268 are secured with stitching, the first and second pieces 266, 268 may be turned right side out. As another example, the first piece 266 and second piece 268 may be sewn to the base layer 202 right side out. Then, seam tape may be secured thereto to cover any stitching or fabric edges.

The first and second pieces 266, 268 may be sized so as to provide clearance between the base layer 202 and the open or lower ends 280, 282 of the outer layer 204. For example, the first and second pieces 266, 268 may be sized so as to provide between about 1 cm and 8 cm of maximum clearance between those elements, and preferably between about 2 and about 6 cm of clearance, although it will be recognized that the amount of clearance may vary depending on the size of the wearer's legs, as the base layer 202 is configured to expand to the contours of those legs while the outer layer 204 remains a generally constant size.

In addition, the lateral sides 276, 278 of the first and second pieces 266, 268 may be attached to the base layer 202 at locations along the front and rear of the base layer 202, respectively. As a result, the lateral portions 292, 294 of the wearer's thigh may be covered only by portions of the base layer 202 and not the outer layer 204, such that the garment 200 is snug against the wearer's skin in those regions.

Turning now to FIGS. 19-27, another garment 300 is depicted. In FIGS. 19-27, it should be understood that each reference numeral in the 300-series corresponds to the respective reference numeral in the 100-series, albeit with a leading prefix of "3" instead of "1". The garment 300 resembles the garment 200 depicted in FIGS. 10-18, with the exception that the base layer 302 in the present garment 300 is shorter than the base layer 202 in garment 200. In particular, the present base layer 302 may only extend to a location slightly below the wearer's knees rather than extending substantially all the way to the user's ankles. As a result, the base layer 302 may include fewer regions of differing stretch resistance as compared to the base layer 202. At the same time, the base layer 302 may be formed according to substantially the same process as base layer 202. Similarly, the outer layer 304 may be formed and attached to the base layer 302 in substantially the same way that the outer layer 204 is formed and attached to the base layer 202, and may be shaped substantially the same as the outer layer 204, having a periphery that has an upper end that defines a concave down shape.

Turning now to FIGS. 28-36, yet another athletic garment 400 is depicted. In FIGS. 28-36, it should be understood that each reference numeral in the 400-series corresponds to the respective reference numeral in the 100-series, albeit with a leading prefix of "4" instead of "1". The garment 400 resembles the athletic garments 200, 300 depicted in FIGS. 10-18 and 19-27, respectively, with the exception that the base layer 402 in the present garment 400 is shorter than the base layer 202, 302 in either of garment 200, 300. In particular, the present base layer 402 may only extend to location slightly above the wearer's knees rather than extending substantially all the way to the user's ankles or to a position slightly below the wearer's knees. As a result, the base layer 402 may include fewer regions of differing stretch resistance as compared to the base layer 202. The base layer 402 may include the same or substantially the same number and placement of regions of differing stretch resistance as compared to base layer 302, with the exception that the region 454 of stretch resistance of the base layer 402 may be significantly shorter than the region 357 of stretch resistance of the base layer 302, i.e., the former both begins and terminates above the knee whereas the latter begins and terminates on opposite sides of the knee. At the same time, the base layer 402 may be formed according to substantially the same process as base layers 202, 302. Similarly, the outer layer 404 may be formed and attached to the base layer 402 in substantially the same way that the outer layers 204, 304 are formed and attached to the base layers 202, 302 respectively.

Turning now to FIGS. 37-45, still another athletic garment 500 is depicted. In FIGS. 37-45, it should be understood that each reference numeral in the 500-series corresponds to the respective reference numeral in the 100-series, albeit with a leading prefix of "5" instead of "1". The garment 500 resembles the athletic garments 200, 300, 400 depicted in FIGS. 10-18, 19-27, and 28-36, respectively, with the exception that the base layer 502 in the present garment 500 is shorter than the base layer 202, 302, 402 in each of garments 200, 300, 400. In particular, the present base layer 502 may only extend to a mid-thigh location. As a result, the base layer 502 may include fewer regions of differing stretch resistance as compared to one or more of the base layers 202, 302, 402. The base layer 502 may include the same or substantially the same number and placement of regions of differing stretch resistance as compared to base layers 302, 402, although the regions of stretch resistance may be sized or configured differently. Alternatively, the base layer may include different regions of stretch resistance as compared to the other garments described herein. For example, the back side of the base layer 502 may divide the region 559 of stretch resistance into a first region 559*a* substantially covering the hamstring region of the wearer and a second region 559*b* substantially covering the gluteal region of the wearer. At the same time, the base layer 502 may be formed according to substantially the same process as base layers 202, 302, 402. Similarly, the outer layer 504 may be formed and attached to the base layer 502 in substantially the same way that the outer layers 204, 304, 404 are formed and attached to the base layers 202, 302, 402 respectively.

In each of garments 200, 300, 400, 500, a waistband 296, 396, 496, 596 may be attached to or formed as an extension of the base layer 202, 302, 402, 502 or the outer layer 204, 304, 404, 504. The waistband may include, e.g., an elastic band and/or a drawstring for additional tightening and security, however other waistband styles may be used.

Although each of the examples discussed above and depicted in the figures includes an outer layer that covers at least a portion of a base layer, which in turn covers at least a portion of a wearer's lower body, it will be appreciated that the outer layer of the garment alternatively may be configured to cover at least a portion of the wearer's upper body. For example, and with regard to the garment 100 shown in FIGS. 1-9, an outer layer may include a first piece and a second piece that cover the front side 122 and back side 134, respectively, of the torso portion 110 of the base layer 102. Such a configuration may be in addition to, or instead of, the outer layer 104 covering the lower section 108 of the base layer 102. Such a configuration also may be in addition to, or instead of, the base layer 102 including a lower section 108 extending below a wearer's waist. In such instances, the first and second pieces of the outer layer may be adhered to the base layer 102 in a manner similar to the base layer adhesion discussed herein. Similarly, the first and second pieces of the outer layer may not cover a periphery of the user's torso, e.g., leaving the regions 164 of increased breathability uncovered, such that the lateral portions of the wearer's torso may be covered only by the compressive base layer 102.

In one aspect, the garment may be an athletic garment that is particularly well-suited for use in team sports, such as soccer, football, rugby, handball, or basketball; however, the garment is not limited to these purposes. As a result of the structure described herein, the garment 100, 200, 300, 400, 500 may serve multiple purposes. For example, and with respect to garment 100 (although it will be understood that similar benefits also may obtain for the other garments depicted and/or described herein), the base layer 102 made of compressible material may provide the wearer with the benefits of such materials as described above. Those benefits may be amplified by forming the base layer 102 of multiple regions of varying stretch resistance and/or compressibility, e.g., providing less stretch resistance in areas where greater support is desired and more stretch resistance in areas where greater flexibility is beneficial. The almost complete lack of seams in the base layer 102 may contribute to increased comfort for the wearer, reduced risks of chafing, and/or elimination of joints that may promote the tearing or other failure of the garment 100. The incorporated outer layer 104 may provide the look or appearance of a uniform component, thereby providing a more polished or complete appearance to the garment 100. Providing an open end and a gap between the layers may promote airflow to the parts of the wearer's body covered by the outer layer 104 while also aiding in heat transfer away from the wearer's body. At the same time, providing a gap between the first and second pieces 166, 168 of the outer layer 104, and in particular providing such a gap along the more exposed lateral portions of the wearer's body, where the wearer's body in that region is covered only by the compressive base layer 102, minimizes the amount of easily grabbable material accessible to the wearer's opponent.

In another aspect, the garment may be configured to serve as a medical support garment. As discussed above, the layout of the various regions of compressibility, as well as the relative degrees of compressibility between or among different regions may differ as compared to a garment configured to serve as an athletic garment, and the largest amount of compressibility in the medical support garment may be greater than that of any region in an athletic garment. Additionally, rather than having an outer layer appear to be a uniform component, in a medical support garment, the outer layer may be configured in one instance to resemble ordinary outerwear clothing.

Although the present disclosure has been described in considerable detail with reference to certain embodiments, one skilled in the art will appreciate that the present invention can be practiced by other than the described embodiments, which have been presented for purposes of illustration and not of limitation. Therefore, the scope of the appended claims should not be limited to the description of the embodiments contained herein.

INDUSTRIAL APPLICABILITY

The invention relates to a multi-layered garment that includes a substantially seamless, compressive base layer in conjunction with an outer layer extending around less than an entire circumferential extent of the garment or of a portion of a wearer's body when the garment is worn.

We claim:

1. A garment, comprising:

a base layer comprising a waistband, the waistband extending around an entire circumference of the garment; and an outer layer, wherein the outer layer extends around less than the entire circumference of the garment, wherein the outer layer includes a first portion disposed on a front side of the garment and a second portion disposed on a back side of the garment, the second portion separated from the first portion on a lateral side of the garment, and a periphery that has an upper end that defines a concave down shape, the upper end being spaced apart from the waistband of the base layer, wherein the outer layer is coupled to the base layer at less than an entirety of the periphery, and wherein the outer layer does not cover at least a portion of a lateral side of the base layer between the first portion and the second portion.

2. The garment of claim 1, wherein the base layer comprises a compressive material.

3. The garment of claim 1, wherein the base layer is configured to lay flat against a wearer's skin.

4. The garment of claim 1, wherein the outer layer is coupled to the base layer using seam tape.

5. The garment of claim 1, wherein the outer layer extends downwards from an area proximate to and spaced apart from the waistband.

6. The garment of claim 1, wherein the base layer is substantially seamless.

7. The garment of claim 6, wherein the base layer includes a first, seamless leg portion and a second, seamless leg portion.

8. The garment of claim 7, wherein the base layer includes a seam coupling the first, seamless leg portion to the second, seamless leg portion.

9. A garment, comprising:

a base layer comprising a waistband and leg portions of a compressive material;

an outer layer positioned outward of at least a portion of the compressive material; and seam tape coupling the outer layer to the base layer along less than an entirety of a periphery of the outer layer, the outer layer having an upper end that defines a concave down shape and is spaced apart from the waistband by a portion of the base layer which, with the garment in a straightened, relaxed configuration, forms at least a portion of an outermost surface of the garment between the waistband and the upper end, wherein the garment has a lateral side and the outer layer is configured to cover less than an entirety of the base layer on the lateral side of the garment, and wherein the base layer is an outermost layer of the garment on at least a portion of the lateral side.

10. The garment of claim 9, wherein the outer layer comprises a first portion disposed on a front side of the garment and a second portion disposed on a back side of the garment.

11. The garment of claim 9, wherein the portion of the circumference not covered by the outer layer includes a portion configured to cover a wearer's lateral thigh regions.

12. The garment of claim 9, wherein the leg portions of the base layer include a first leg portion and a second leg portion, the first and second leg portions being seamless.

13. The garment of claim 12, wherein the base layer includes a seam coupling the first leg portion to the second leg portion.

14. A garment, comprising:

a base layer comprising a waistband, the waistband extending around an entire circumference of the garment; and an outer layer, wherein the outer layer extends around less than the entire circumference of the garment, wherein the outer layer includes a first portion disposed on a front side of the garment and a second portion disposed on a back side of the garment and separated from the first portion on a lateral side of the garment, and a periphery of the first portion of the outer layer that has an upper end that defines a concave down shape, the upper end being spaced apart from the waistband of the base layer, wherein the outer layer does not cover at least a portion of a lateral side of the base layer between the first portion and the second portion and wherein the base layer is an outermost layer of the garment within said portion of the lateral side between the first and second portions of the outer layer.

15. The garment of claim 14, further comprising seam tape coupling the outer layer to the base layer.

16. The garment of claim 15, wherein the seam tape couples upper and lateral portions of the front side portion and the back side portion to the base layer.

* * * * *